US006182301B1

(12) United States Patent
Krueger et al.

(10) Patent No.: US 6,182,301 B1
(45) Date of Patent: Feb. 6, 2001

(54) APPARATUS AND METHOD FOR AUTOMATICALLY PIVOTING A FIRST MEMBER RELATIVE TO A SECOND MEMBER

(75) Inventors: Harold Krueger, Morocco; Karl Zemlin, Indianapolis, both of IN (US)

(73) Assignee: Creative Innovation, Inc., Plainfield, IN (US)

( * ) Notice: Under 35 U.S.C. 154(b), the term of this patent shall be extended for 0 days.

(21) Appl. No.: 09/374,954

(22) Filed: Aug. 16, 1999

(51) Int. Cl.[7] ..... A47X 13/12
(52) U.S. Cl. ..... 4/248; 4/246.1
(58) Field of Search ..... 4/246.1, 246.2, 4/248

(56) References Cited

U.S. PATENT DOCUMENTS

| | | |
|---|---|---|
| 452,684 | 5/1891 | Webster . |
| 1,134,755 | 4/1915 | Marcuse . |
| 1,743,079 | 1/1930 | Burkett et al. . |
| 1,830,361 | 11/1931 | Humphries . |
| 2,104,947 | 1/1938 | Joosten . |
| 2,200,687 | 5/1940 | Bercot . |
| 2,877,469 | 3/1959 | Johnson . |
| 3,404,411 | 10/1968 | Newkirk . |
| 3,781,924 | 1/1974 | Davis, Jr. . |
| 4,195,372 | 1/1980 | Farina . |
| 4,402,092 | 9/1983 | Smallwood . |
| 4,491,989 | 1/1985 | McGrail . |
| 4,914,757 | 4/1990 | Johnson . |
| 4,984,666 | 1/1991 | Orii et al. . |
| 4,995,120 | 2/1991 | Tager . |
| 5,010,601 | 4/1991 | Kobayashi et al. . |
| 5,153,946 | 10/1992 | Yoke et al. . |
| 5,193,228 | 3/1993 | Murasawa et al. . |
| 5,193,230 | 3/1993 | Guerty . |
| 5,255,396 | 10/1993 | Miyahara et al. . |
| 5,267,356 | 12/1993 | Gideon et al. . |
| 5,276,945 | 1/1994 | Matsumura . |
| 5,279,000 | 1/1994 | Mercier et al. . |
| 5,388,281 | 2/1995 | Wiklund et al. . |
| 5,546,612 | 8/1996 | Johnson . |
| 5,570,478 | 11/1996 | Armstrong . |
| 5,604,936 | 2/1997 | Mausolf . |
| 5,642,532 | 7/1997 | Morant . |
| 5,724,683 | 3/1998 | Sorimachi et al. . |
| 5,768,718 | 6/1998 | Sorimachi . |
| 5,794,277 | 8/1998 | Jones . |

*Primary Examiner*—Robert M. Fetsuga
(74) *Attorney, Agent, or Firm*—Woodard, Emhardt, Naughton, Moriarty & McNett

(57) ABSTRACT

An apparatus for automatically pivoting a first member relative to a second member comprises a housing connectable to the second member; a shaft connectable to the first member and juxtaposed to rotate about its axis within the housing between a rest position and an open position, the shaft having first and second rates of rotation in a closing direction from the open to the rest position; a torsion spring assembly connected between the housing and the shaft; a dampening assembly connected between the housing and the shaft for exerting a dampening torque upon the shaft during at least one direction of rotation of the shaft relative to the housing; a time delay assembly connected between the housing and the shaft for variably exerting a braking torque on the shaft; a shift assembly connected between the housing and the shaft and operable to enable and disable the time delay assembly; and, a clutch assembly for engaging the shaft with the dampening assembly and the time delay assembly when torque is applied to rotate the shaft in the closing direction.

53 Claims, 22 Drawing Sheets

206
230
231
232
232
233
236
235
237
244
245

319
321
337
339
339
340
321
343
344
344
346
320
323
318
324
334
335

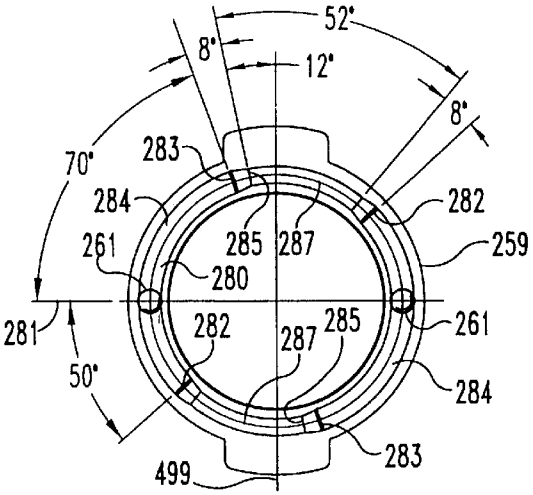
Fig. 28
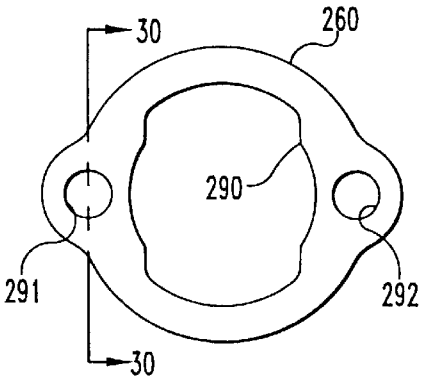
Fig. 29
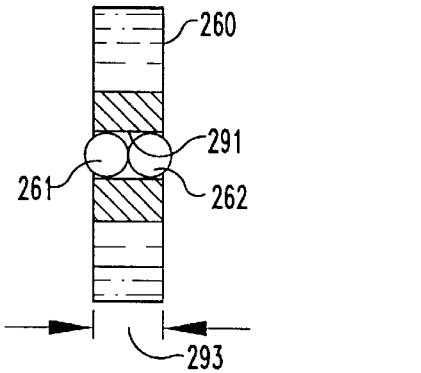
Fig. 30
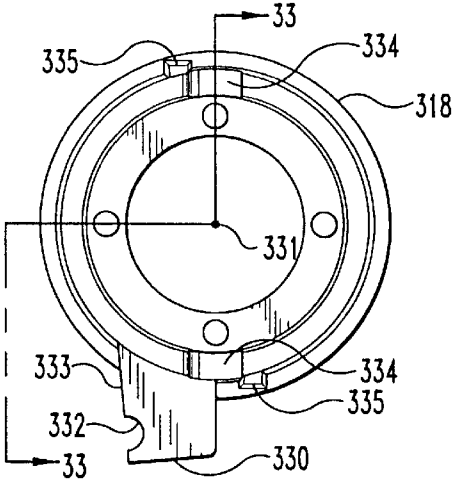
Fig. 31
Fig. 32
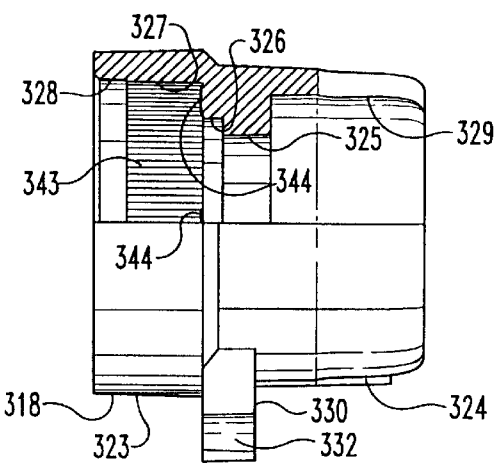
Fig. 33

APPARATUS AND METHOD FOR AUTOMATICALLY PIVOTING A FIRST MEMBER RELATIVE TO A SECOND MEMBER

FIELD OF THE INVENTION

The present invention relates to the field of automatic closing devices, and in particular to an apparatus for automatically pivoting one member relative to another member to which it is pivotally connected such as for automatically closing a toilet bowl lid and/or seat upon a toilet bowl.

BACKGROUND OF THE INVENTION

A common complaint associated with free-swinging toilet seats and lids is that one or both is left in the up or open position after use. During the nighttime, the subsequent user, who may be half-asleep and may disregard turning on the lights, is usually startled by sitting directly on or within the rim of the toilet bowl. Some also suggest that proper bathroom etiquette requires that both the lid and the seat be left down or closed when the commode is not in use so that the inside of the bowl is not readily accessible to the curious young child or family dog or cat.

Several solutions to this problem have been developed such as the device described in U.S. Pat. No. 4,195,372 which automatically closes the toilet lid after use. There, a simple leaf spring interposed between the toilet seat and its lid ensures that the seat will stay down unless held up by manually lifting it against the reactive force of the spring. In U.S. Pat. No. 1,743,079, a device uses a spring-loaded plunger to automatically close the lid or the lid and the seat unless someone is sitting on the seat, which action temporarily allows the lid to stay open until the weight is removed from the seat. In U.S. Pat. No. 1,134,755, a device is disclosed which uses a weighted, pivotally mounted rocker arm to automatically close a toilet lid unless held open. The rocker arm may be temporarily disabled from closing the lid by sitting on the seat. Another device, disclosed in U.S. Pat. No. 1,830,361, prevents the toilet lid from being pivoted to a stable, upright position unless the lid is pushed back far enough, against the bias of a spring, to shift the toilet seat forward. When someone sits on the forward-shifted seat, the lid will remain in the upright position. Upon removing the weight from the seat, a spring system pulls the seat and hinge of the lid rearwardly and past a gravitationally stable position allowing it to slam shut. In U.S. Pat. Nos. 452,684 and 2,104,947. devices are shown wherein the toilet lid may be pivoted all the way back to a cocked or loaded position which holds the lid open and wherein the toilet seat is pivoted slightly upwards. Upon sitting on the seat, the respective mechanism is advanced to an intermediate stage. When weight is next removed from the seat, the device is triggered from the intermediate stage to automatically pivot the lid closed with the aid of gravity, the '947 device providing a friction disk member for slowing the descent of the lid.

While these devices seem to solve the problem of closing a toilet lid and/or seat after use, they create a number of new problems. Some of the above-described mechanisms will inherently not allow the toilet seat to be raised. Some, while allowing both the seat and the lid to be raised in order to use the facility as a urinal, must be manually held in the upright position during use. And a problem with nearly all of these devices is that the lid is automatically caused to close immediately after weight is removed from the toilet seat. A person, especially one who is disable or handicapped, could be struck by the falling lid if he or she cannot rise quickly enough from the seat.

What is needed is a device which automatically closes the toilet lid and/or seat safely and economically and without substantially inhibiting the normal operation of the standard free-swinging toilet lid and/or seat.

Just as the toilet lid or seat is lifted and left up despite the desire it be closed after use, other hingedly mounted objects are often left open when it is desired that they be closed. Examples of such structures include garden and back yard gates, kitchen cabinet doors, and closet doors. Each of these doors and gates, as well as an endless variety of other hingedly connected objects, are frequently opened or pivoted, and then left in the open or pivoted position after use, much to the dismay of the owner, allowing ingress or egress of pets, people, dust, bugs or other unwanted items. The same device that satisfies the aforedescribed need to automatically close the toilet lid and/or seat, safely and economically and without substantially inhibiting the normal operation of the standard free-swinging toilet lid and/or seat would similarly benefit a wide variety of other hingedly or pivotally mounted objects that may be pivoted from a first rest position to a second position and that are desired to be returned to the rest position after a predetermined time.

SUMMARY OF THE INVENTION

Generally speaking, the present invention provides a device for holding a first member, such as a toilet bowl lid and/or seat, in an open position relative to a second member, such as a toilet bowl, to which it is pivotally connected, and then after the passage of a predetermined period of time, automatically closing or pivoting the first member back against the second member at a dampened rate, the predetermined period of time being variable.

An apparatus for automatically pivoting a first member relative to a second member comprises a housing connectable to the second member; a shaft connectable to the first member and juxtaposed to rotate about its axis within the housing between a rest position and an open position, the shaft having first and second rates of rotation in a closing direction from the open to the rest position; a torsion spring assembly connected between the housing and the shaft; a dampening assembly connected between the housing and the shaft for exerting a dampening torque upon the shaft during at least one direction of rotation of the shaft relative to the housing; a time delay assembly connected between the housing and the shaft for variably exerting a braking torque on the shaft; a shift assembly connected between the housing and the shaft and operable to enable and disable the time delay assembly; and, a clutch assembly for engaging the shaft with the dampening assembly and the time delay assembly when torque is applied to rotate the shaft in the closing direction. In one embodiment, the first member is a toilet bowl and the second member is either or both a toilet lid and a toilet seat. The apparatus also provides for selective adjustment of duration of activation of the time delay assembly.

It is an object of the present invention to provide an improved device for automatically pivoting one member relative to another member to which it is pivotally connected.

It is an object of the present invention to provide an improved device for automatically closing the lid of a toilet facility.

It is another object of the present invention to provide a device for automatically closing the lid or seat of a toilet facility after a predetermined time.

It is another object of the present invention to provide an improved device for automatically closing, pivoting, rotating, translating or moving one device relative to another device, either manually or by the action of a mechanical device, after a predetermined time.

Further objects and advantages of the present invention will become apparent from the following description of the preferred embodiment.

BRIEF DESCRIPTION OF THE DRAWINGS

FIG. 28 is an end view of the shift plate 259 of the apparatus 200 of FIG. 20.

FIG. 29 is an end view of the ball carrier 260 of the apparatus 200 of FIG. 20.

FIG. 30 is a side cross-sectional view of the ball carrier 260 of FIG. 29 taken along the lines 29—29 and viewed in the direction of the arrows.

FIG. 31 is a top view of the brake pressure plate 253 of apparatus 200 of FIG. 20.

FIG. 32 is an end view of rotor casing 318 of apparatus 200 of FIG. 20, and viewed from the left as viewed in FIG. 20.

FIG. 33 is a side, partially cross-sectional view of rotor casing 318 of FIG. 32 taken along the line 33—33 and viewed in the direction of the arrows.

DESCRIPTION OF THE PREFERRED EMBODIMENT

Figure 4:
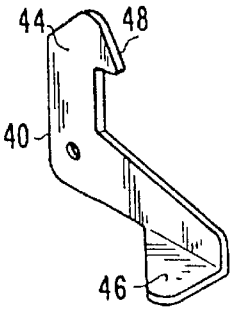
FIG. 4 is a perspective view of the seat catch lever of the apparatus shown in FIG. 2.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIGS. 1–5, there is shown an apparatus 10 for automatically closing a toilet bowl lid in accordance with the one embodiment of the present invention. The preferred embodiment of the present invention is shown in FIGS. 20–51 and is described below with reference to FIGS. 20–51. Apparatus 10 generally includes a housing 11 which is mounted to a toilet bowl 12 just forward of the tank 13. Housing 11 is secured to toilet bowl 12 by conventional anchor bolts 14 which extend downwardly from anchor bolt head slots 14A which are defined in the bottom of housing 11. A control shaft 15 and a fixed shaft 16 extend outwardly from opposite ends of housing 11. A toilet seat 17 and toilet lid 18 are pivotally mounted at shafts 15 and 16 to rotate about the shafts' common axis 19. Housing 11 holds the majority of the components of apparatus 10 and comprises a control-retarder enclosure 22, a timer enclosure 23, and left and right end caps 24 and 25, respectively. Enclosures 22 and 23 and end caps 24 and 25 are held tightly together by a number of appropriate bolts 26 which extend longitudinally from one end cap (25) to the other (24). Fixed shaft 16 is an integral extension of right end cap 25. Control shaft 15 cooperates with various components within housing 11 as described herein and extends outwardly through a hole in left end cap 24.

Lid 18 has a pair of outer hinge portions 28A and 28B and seat 17 has a pair of inner hinge portions 27A and 27B. Each of the four hinge portions defines an inwardly extending notch 29 (FIG. 2) which allows each of seat 17 and lid 18 to be slid laterally onto shafts 15 and 16 with the shafts nested firmly within the corresponding notches. The left hinge portion 28A of lid 18 defines a forward screw hole 32 and a rear screw hole 33. Holes 32 and 33 extend through hinge portion 28A, both above and below notch 29. A screw 34 extends through forward hole 32 and through an aligned, diametric hole defined in control shaft 15, thereby securing lid 18 to rotate with shaft 15 about its axis 19. The left hinge portion 27A of seat 17 is provided with similarly aligned forward and rear holes. A screw 35 extends through the rear hole of hinge portion 27A, the screw 35 passing tangentially behind control shaft 15 to secure seat 17 to shaft 15, but to allow it to rotate freely thereabout. Right hinge portions 27B and 28B are also provided with inwardly extending notches and each have only a rear screw hole through which extends a single corresponding screw 36 which passes tangentially behind fixed shaft 16 to hold its respective seat 17 or lid 18 for free rotation about fixed shaft 16. With this arrangement, lid 18 pivots freely about shaft 16 and pivots as a unit with control shaft 15, while seat 17 pivots freely about both fixed shaft 16 and control shaft 15. If it is desired that apparatus 10 automatically close only seat 17, screw 35 would be moved to the forward hole 37 (and through an aligned hole (not shown) in control shaft 15) to lock seat 17 with shaft 15. Also, screw 34 would be moved from forward hole 32 to rear hole 33 to allow lid 18 to pivot freely about shaft 15.

Figure 1:
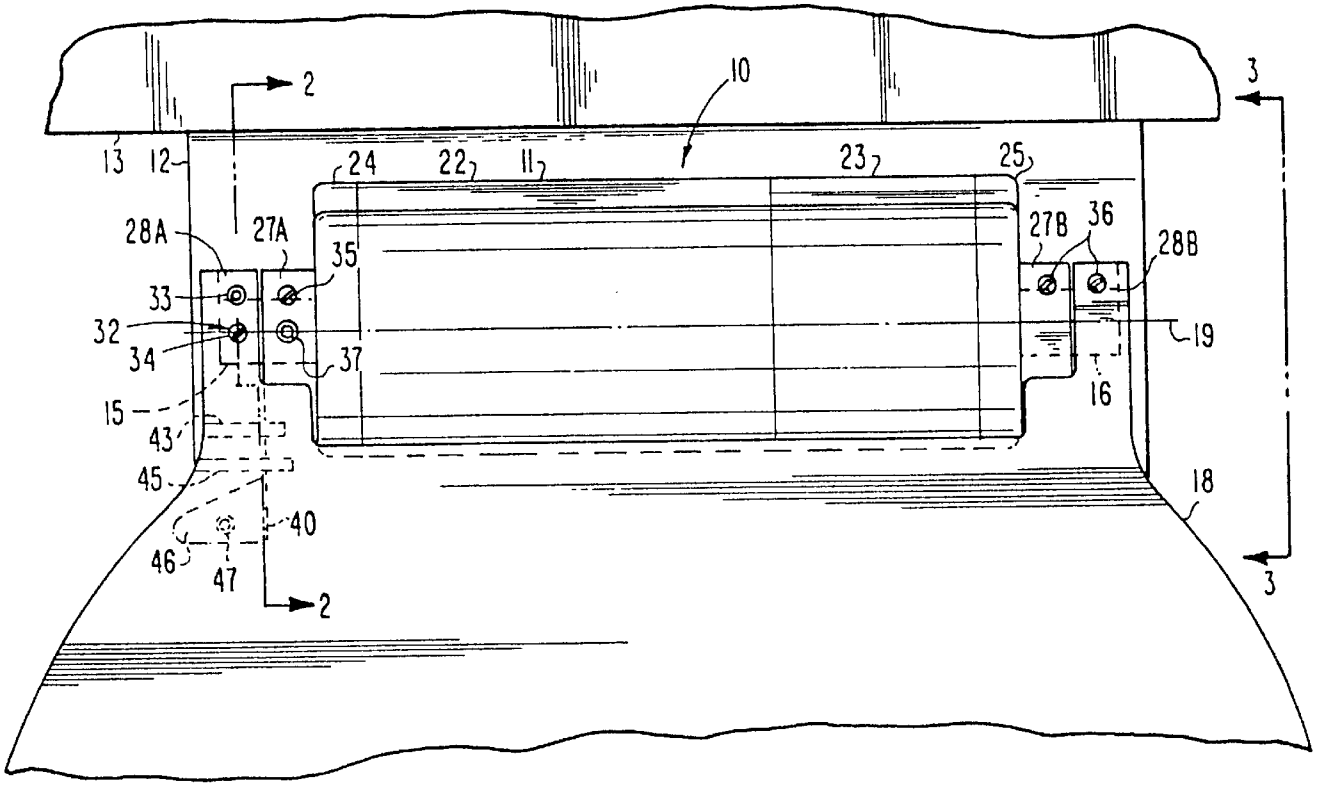
FIG. 1 is a plan view of an apparatus for automatically closing a toilet bowl lid in accordance with one embodiment of the present invention and shown mounted to a conventional toilet.
Figure 3:
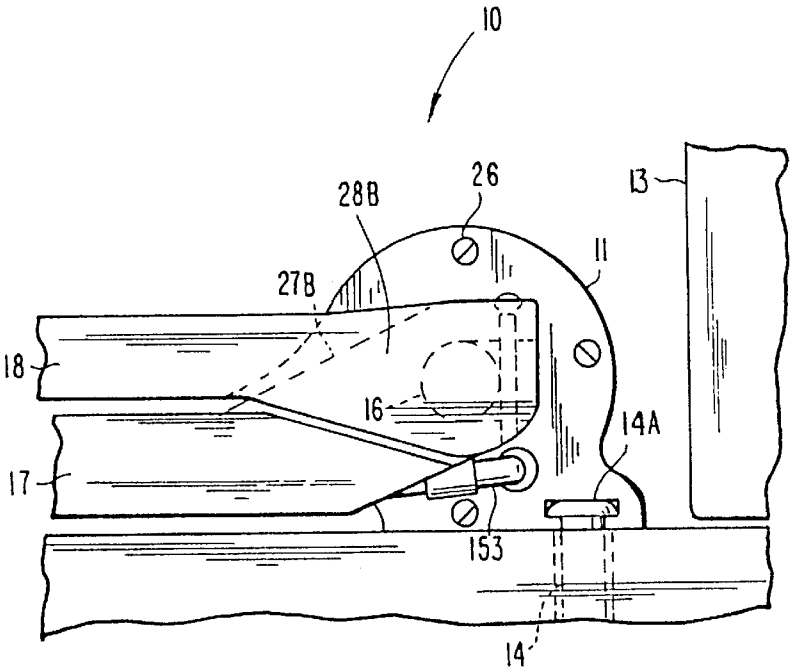
FIG. 3 is a side, elevational view of the apparatus of FIG. 1, taken along the line 3—3 and viewed in the direction of the arrows.
Figure 2:
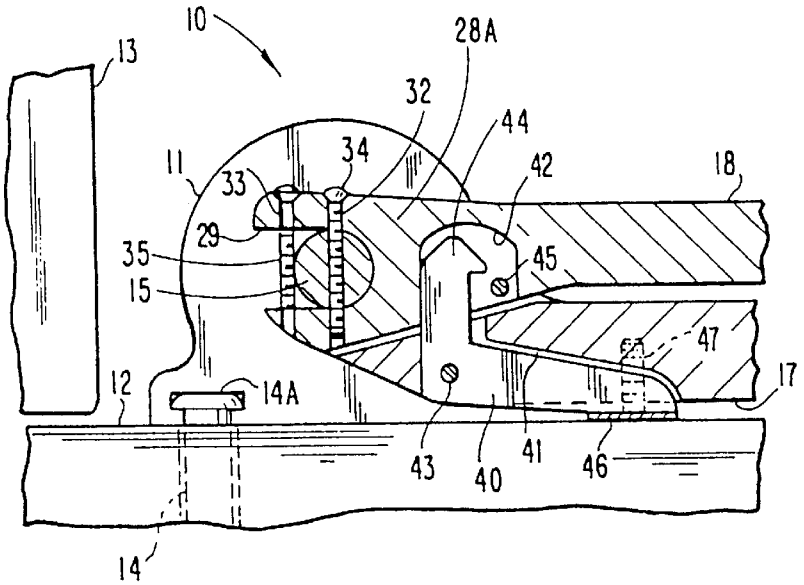
FIG. 2 is a side, cross-sectional view of the apparatus of FIG. 1, taken along the line 2—2 and viewed in the direction of the arrows.

Referring to FIGS. 1, 2 and 4, the present invention includes a generally L-shaped seat catch lever 40 to provide cooperative movement among apparatus 10, seat 17 and lid 18. Seat 17 and lid 18 define appropriately shaped slots 41 and 42, respectively, for receipt of corresponding portions of lever 40 as shown in FIG. 2. Lever 40 is mounted for limited pivotal movement within slot 41 by a horizontally extending pin 43. Lever 40 includes an upper hook portion 44 which extends into slot 42 when lid 18 is pivoted against seat 17. A catch pin 45 extends horizontally into lid 18 and through slot 42. Lever 40 also includes a horizontally extending flange portion 46 which extends orthogonally from the rest of flange 40 and rides just below the bottom surface of seat 17. A spring 47 (FIG. 1 and its positionment relative to flange 46 shown in phantom in FIG. 2) is positioned within a bore in the bottom of seat 17. Spring 47 bears against flange 46 to urge seat catch lever 40 clockwise as shown in FIG. 2. When seat 17 is in its closed position, adjacent bowl 12 (FIG. 2), flange 46 contacts the top of bowl 12, pivoting lever 40 counterclockwise against the bias of spring 47. In this position, lid 18 may be lifted and catch pin 45 of lid 18 will clear hook portion 44 which allows lid 18 to be lifted independently of seat 17. If seat 17 is lifted even slightly, seat catch lever 40 will be pivoted slightly clockwise by spring 47, hook portion 44 will engage with catch pin 45, and lid 18 will be locked to move as a unit with lid 18. A cam surface 48 on hook portion 44 permits lid 18 and seat 17 to be brought together from any position with cam surface 48 engaging catch pin 45 to pivot lever 40 until pin 45 has passed below and locked with hook portion 44. If lid 18 and seat 17 are raised together and it is decided that only lid 18 is to be raised, seat catch lever 40 may be disengaged from lid 18 either by manually depressing flange 46 from below or by closing both lid 18 and seat 17 and the lifting only lid 18.

Figure 5:
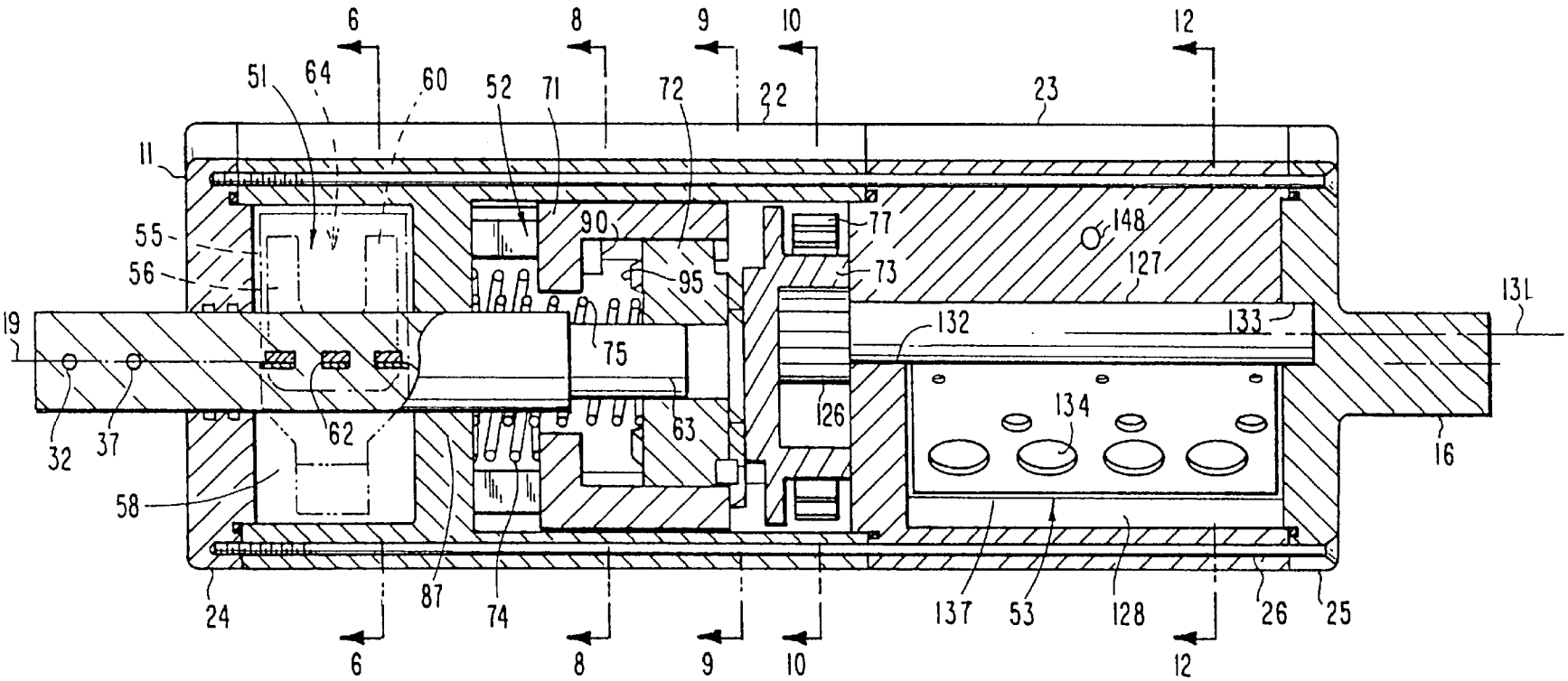
FIG. 5 is a top, cross-sectional view of the apparatus of FIG. 1, the cross-section being taken generally in the horizontal plane through axis 19 of shaft 15.

Referring to FIG. 5, housing 11 contains a retarding mechanism 51, a control mechanism 52 and a timing mechanism 53. In general, retarding mechanism 51 dampens the predominately gravity-powered closing of lid 18; timing mechanism 53 provides an adjustable, mechanical timer with a mechanical output indicating the amount of time that lid 18 has been in the open position and excluding time that weight has been applied to seat 17; and, control mechanism 52 cooperates with timing mechanism 53 and locks seat 18 in the open position, cocks timing mechanism 53, and releases seat 18 when timing mechanism 53 has mechanically indicated passage of a predetermined time.

The Retarding Mechanism

Figure 6:
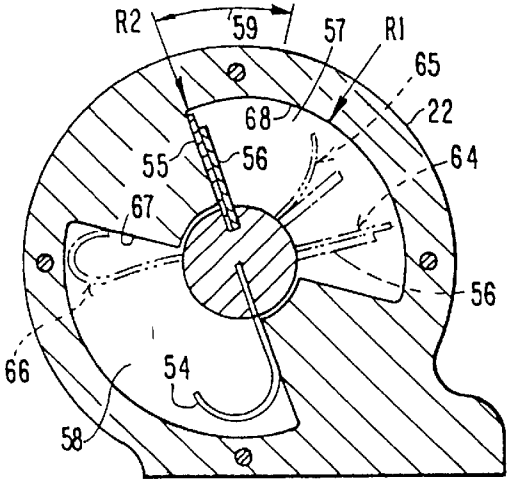
FIG. 6 is a side, cross-sectional view of the apparatus of FIG. 5, taken along the line 6—6 and viewed in the direction of the arrows.

Referring to FIGS. 5 and 6, retarding mechanism 51 includes a retarder chamber 57, a spring return chamber 58, and a retarder vane comprising a retarder spring 55 and a retarder spring support 56. Chambers 57 and 58 are defined by one end of control-retarder enclosure 22 and by left end cap 24. Each chamber has 57 and 58 sweeps through an angle of roughly 120° C. and a constant width. In one embodiment, the radius R1 of chamber retarder 57 measured from the axis of shaft 15 is 0.9375 inches. Through the last 30° (at 59) of the upper end of retarder chamber 57, the radius gradually decreases from the R1 value down to a value R2 of approximately 0.875 inches.

Retarder spring 55 is made of spring metal while retarder spring support 56 is made of a material such as plastic and is U-shaped and substantially inflexible. Spring 55 and support 56 is fixedly connected to shaft 15 so that, as mounted within housing 11, support 56 and the upper half of spring 55 are mutually adjacent and extend into retarder chamber 57 while the J-shaped lower half of 54 extends into spring return chamber 58. In one embodiment, spring 55 and support 56 are provided mutually aligning holes 62, and shaft 15 is plastic and is molded right around spring 55 and support 56. Holes 62 permit the plastic on both sides of the spring and support to be integrally connected through holes 62, thereby enhancing the strength of the bond between shaft 15 and spring 55 and support 56. The upper half of retarder spring 55 extends from shaft 15 into retarder chamber 57 with a width substantially identical to the width of chamber 57 and a radial length measured from the axis of shaft 15 approximately equal to radius R2. The lower half of spring 55 has a J-shape 54 and a width substantially less than the width of spring return chamber 58. Both chambers 57 and 58 are filled with an appropriate fluid medium such as air or vegetable oil. The cross-section of the majority of shaft 15 is circular while the inner end 63 has a square cross-section.

As described above, lid 18 is secured to shaft 15 with a bolt 34 through hole 32 to rotate as a unit therewith. When lid 18 is in the closed position (FIG. 2), spring 55 and support 56 are positioned within chambers 57 and 58 as shown in solid lines in FIG. 6. When seat 17 is lifted (that is, pivoted about axis 19), shaft 15, spring 55 and support 56 are rotated clockwise (as shown in FIG. 6) through an angle of roughly 95° and to the open position indicated at 64 and shown in phantom in FIGS. 5 and 6. Because there is little clearance between the upper portion retarder spring 55 and the interior walls of retarder chamber 57, a drag force against clockwise rotation of retarder spring 55 through chamber 57 is created. The elasticity of spring 55, however, allows it to bend backwardly (at 65) as support 56 continues to rotate with shaft 15 toward the open position at 64. As the elasticity of the upper half of spring 55 urges it toward the open position at 64, the fluid in chamber 57 moves around spring 55 and spring 55 slowly moves toward and joins support 56 at the open position at 64. Another consequence of rotating shaft 15 through its angle of roughly 95° is that the lower, J-shaped half 54 of spring 55 is rotated to its open position (at 66) at which point J-shaped 54 meets upper wall 67 of chamber 58 and is deformed, thereby creating a spring-loaded condition for shaft 15 and lid 18. When lid 18 is ultimately released from the open position by control mechanism 52 as described herein, the unloading of stressed J-shape 53 will initially rotate shaft 15 and thereby lid 18 far enough for gravity to take over and urge lid 18 to the closed position. Through the closing stroke, support 56 and the upper half of spring 55 rotate counterclockwise through retarder chamber 57. Drag is again produced as the upper half of spring 55 moves through the oil-filled, nearly identically dimensioned chamber 57. However, unlike the clockwise rotating, opening stroke, support 56 precludes spring 55 from bending rearwardly of the direction of its movement and the drag on spring 55 is sufficient to substantially retard the rotation of spring 55, support 56, shaft 15 and thereby lid 18 (and seat 17 if connected thereto by seat catch lever 40 as described above). Over the last 30° of closing rotation 59, the inner radius of chamber 57 gradually decreases from R1 to R2, which reduces further the clearance between spring 55 and inner wall 68 of chamber 57, which gradually increases the drag and retarding force, and which gradually slows the descent and produces a soft landing of lid 18.

The Control Mechanism

Referring to FIGS. 5 and 7 through 11, control mechanism 52 is contained within a shaped cavity 83 defined in an end of control-retarder enclosure 22 opposite retarder chamber 57 and spring return chamber 58. Control mechanism 52 generally includes lid release yoke 71, primary cam 72, timer ring 73, lid release yoke spring 74, primary cam spring 75, a pair of opposing primary shift pins 76, and timer power spring 77. In describing the components of control mechanism 52, the front or front side of a component will be that portion or side which is nearest to right end cap 25 and the rear or rear side will be that which is closest to left end cap 24.

Looking at FIGS. 5 and 7 through 9, yoke 71 has an annular base 80 and a pair of opposing, identical, arcuate arms 81. Base 80 defines a hole 82 through which extends shaft 15 and coaxial primary cam spring 75. The inner end of cavity 83 of enclosure 22 is shaped to receive yoke 71 for sliding reciprocation along axis 19, but to preclude its rotation about axis 19. The distal ends of arms 81 define diametrically opposed cam surfaces 84 and diametrically opposed cam rest platforms 86. Each surface 84 and each platform 86 is substantially planar and orthogonal to axis 19. Cam ramps 85, which lead from surfaces 84 to platforms 86, are on the clockwise side of platforms 86 (as viewed in FIGS. 7 and 9). Three equally spaced apart teeth 90 extend from the front side of base 80 toward right end cap as assembled and shown in FIG. 5, with one tooth 91 of teeth 90 being centered in horizontal plane 92 which cuts through axis 19.

Figure 9:
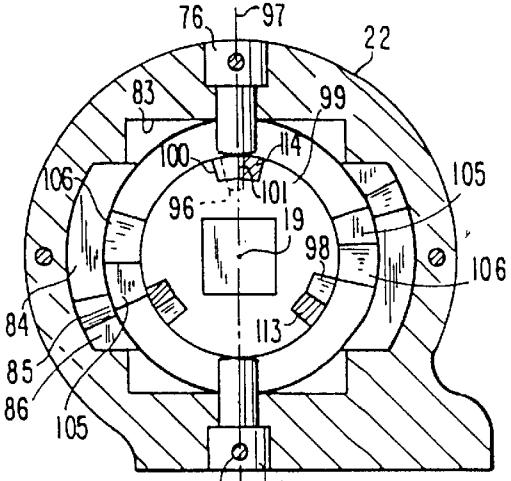
FIG. 9 is a side, cross-sectional view of the apparatus of FIG. 5, taken along the line 9—9 and viewed in the direction of the arrows.
Figure 8:
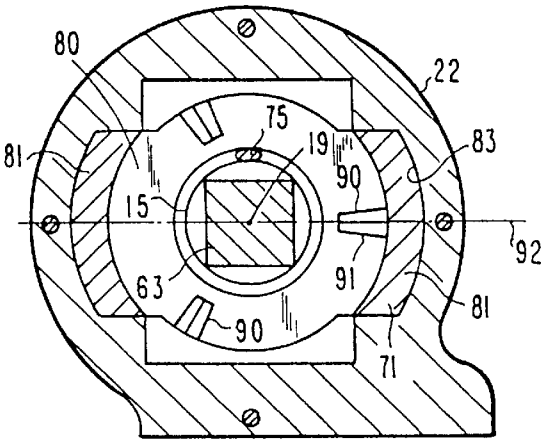
FIG. 8 is a side, cross-sectional view of the apparatus of FIG. 5, taken along the line 8—8 and viewed in the direction of the arrows.
Figure 7:
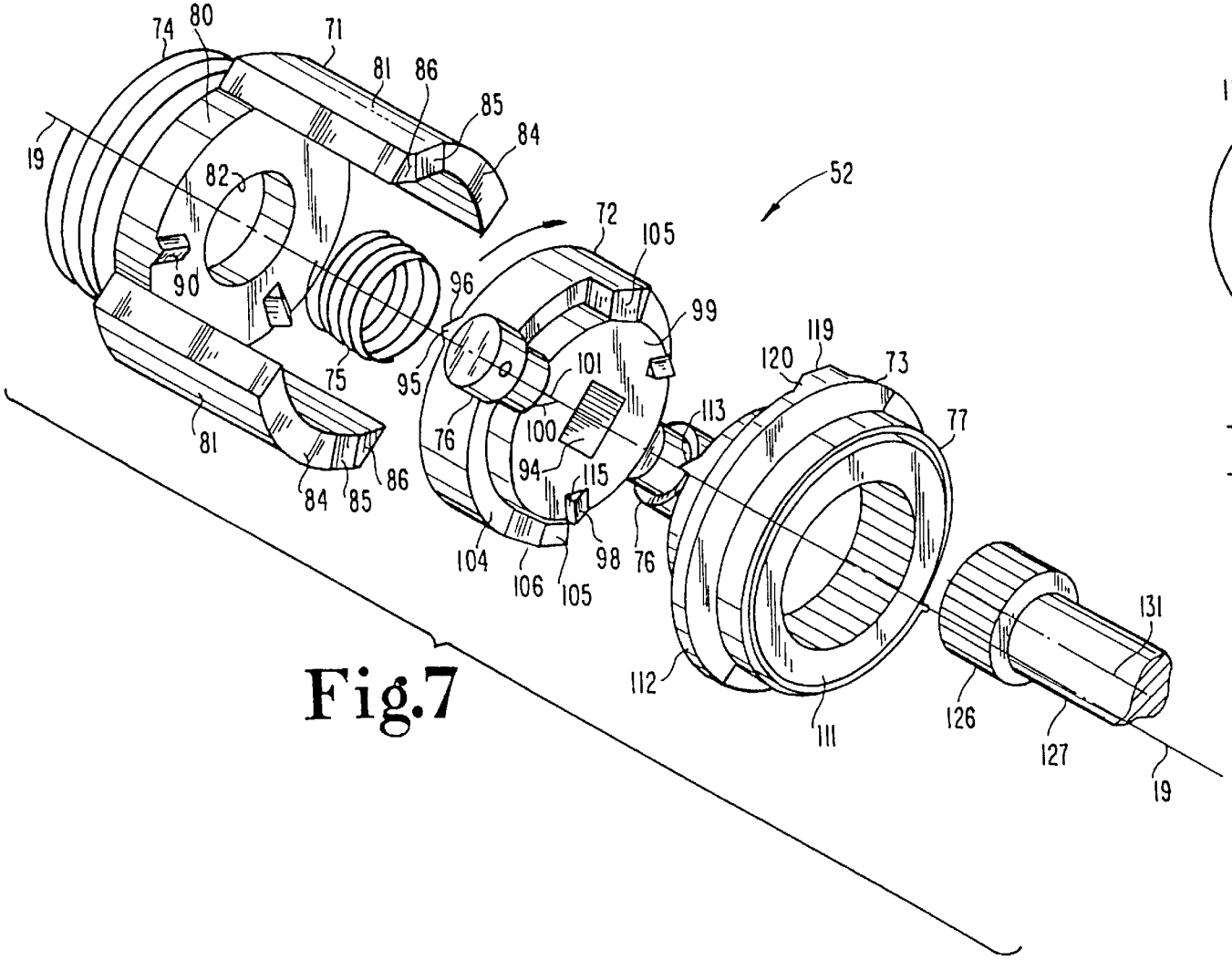
FIG. 7 is an exploded, perspective view of the components of control mechanism 52 of the apparatus of FIG. 5.

Referring to FIGS. 5, 7 and 9, primary cam 72 has a generally round cross-section and is adapted to both rotate and reciprocate axially within and between arcuate arms 81 without restriction therefrom. Cam 72 defines a central, square cross-sectioned opening 94 through which the square cross-sectioned end 63 of shaft 15 can freely, axially reciprocate. The rear side of primary cam 72 defines three teeth 95 (one shown in FIG. 7, the other two shown in FIG. 5) which are disposed 120° apart about axis 19. With control mechanism 52 assembled as shown and in the lid down or closed position, one tooth 96 of teeth 95 is disposed substantially centered in the vertical plane 97 which passes through axis 19. (FIG. 9) Teeth 95 are similar to and are adapted to engage with teeth 90 of lid release yoke 71 as described herein. Three ratchet teeth 98 extend forwardly from the front side 99 of primary cam 72 and are disposed 120° apart. With control mechanism 52 assembled as shown and in the lid down or closed position, one ratchet tooth 100 of teeth 98 is disposed so that its ratchet face 101 (perpendicular to front face 99) lies in vertical plane 97. An annular shoulder 104 is defined substantially completely around front faced 99 and is interrupted only by diametrically opposed cam platforms 105. Cam ramps 106, which lead from shoulder 104 to platforms 105, are on the clockwise side of platforms 105 (as viewed in FIGS. 7 and 9). Primary shift pins 76 are mounted in appropriate openings in control-retarder enclosure 22 so that pins 76 extend radially inwardly toward axis 19, the inner ends of pins 76 being adapted to extend into shoulder 104 of primary cam 72 and to engage with ramps 106 and platforms 105 upon appropriate rotation of primary cam 72 as described below. Each pin 76 has a hole 107 in its outer section through which extends one corresponding bolt 26 to hold pin 76 in position.

Figure 10:
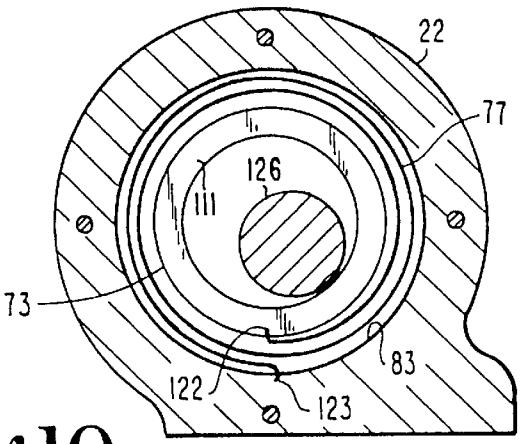
FIG. 10 is a side, cross-sectional view of the apparatus of FIG. 5, taken along the line 10—10 and viewed in the direction of the arrows.
Figure 11:
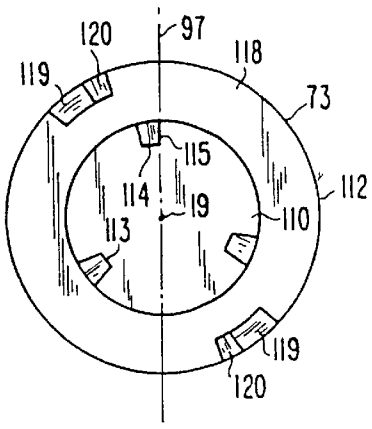
FIG. 11 is an elevational view of the rear face of timer ring 73 of FIG. 7.

Referring to FIGS. 5, 7, 10 and 11, timer ring 73 defines a rear face 110, a forwardly extending ring gear 111 and an annular plate 112 therebetween. Three ratchet teeth 113 extend rearwardly from rear face 110 and are disposed 120° apart about axis 19. With control mechanism 52 assembled as shown and in the lid down or closed position, one tooth 114 of teeth 113 is disposed so that its ratchet face 115 (perpendicular to rear surface 110) lies within vertical plane 97 and engagingly adjacent face 101 of tooth 100 of primary cam 72 (see FIG. 9). Ratchet teeth 113 are disposed so that their ratchet faces 115 all face in the clockwise direction as viewed from the rear (FIG. 11). Likewise, ratchet teeth 98 of primary cam 72 are disposed so that their ratchet faces 101 all face in the clockwise direction as viewed from the front (FIGS. 7 and 9). Outwardly extending annular plate 112 defines an annular shoulder 118 which surrounds rear face 110. A pair of diametrically opposed, ramped platforms 119 extend rearwardly from plate 112 and shoulder 118 with the ramps 120 being on the clockwise side of platforms 119 as viewed from the rear (FIG. 11). At the forward end of control-retarder enclosure 22, the cross-section of cavity 83 is round and adapted to receive timer ring 73 therein.

The outside of rearwardly extending ring gear 111 defines a cylindrical surface around which is wrapped timer power spring 77. Spring 77 is a spiral coil spring and is mounted at one end 122 to ring gear 111. From there, spring 77 spirals outwardly counterclockwise (as viewed in FIG. 10) to its anchored end 123 in enclosure 22. A pinion 126 mounted to the end of timer shaft 127 meshes with ring gear 111.

Primary cam spring 75 coaxially surrounds shaft 15 and extends in compression between bulkhead 87 and primary cam 72 to urge cam 72 forwardly and against timer ring 73. Lid release yoke spring 74 coaxially surrounds primary cam spring 75 and shaft 15 and is disposed in compression between bulkhead 87 and lid release yoke 71 to urge yoke 71 forwardly and against plate 112 of timer ring 73.

From the closed position (lid 18 and seat 17 closed against toilet bowl 12), raising lid 18 (pivoting it about axis 19), rotates shaft 15 which rotates primary cam 72, causing ratchet teeth 98 to engage ratchet teeth 113 and to rotate timer ring 73 about axis 19, which in turn rotates pinion 126 and its timer shaft 127 at a ratio of approximately 1.74 to 1. The lid lifting stroke and consequential rotation of timer ring 73 also winds timer power spring 77. Upon rotation of lid 18 through an angle of roughly 95°, ramped platforms 105 of primary cam 72 engage with shift pins 76 which move primary cam 72 rearwardly and away from timer ring 73. This movement disengages ratchet teeth 98 from ratchet teeth 113 thus allowing timer ring 73 to be rotated by the unwinding of coil spring 77. The rearward movement of primary cam 72 also moves teeth 95 of cam 72 into an engaging position with teeth 90 of yoke 71, the lid lifting stroke having rotated cam 72 enough so that the three teeth 95 have moved just clockwise (as viewed from the front in FIGS. 7 and 8) of teeth 90. Thus, when primary cam 72 is moved rearwardly against annular base 80, teeth 90 of stationary yoke 71 will temporarily lock cam 72, and thereby lid 18, from rotating back to the closed position. Lid 18 is now locked in the open position. As described above, in this position, lid 18 is urged toward the closed position by the deformation of the lower, J-shaped half 54 of spring 55 against upper wall 67 of chamber 58.

Lid 18 may be moved out of this open and locked position in either of two ways. First, because each of teeth 90 of yoke 71 and each of teeth 95 of cam 72 are somewhat beveled on both sides thereof, lid 18 may be manually pulled toward the closed position. The camming action between teeth 90 and 95 created by manually rotating lid 18 and cam 72 toward the closed position pushes yoke 71 rearwardly against the bias of lid release yoke spring 74 until teeth 95 have popped over and past teeth 90, thereby releasing cam 72 from yoke 71. The second way in which lid 18 is released from the open position is through expiration of a preset time at which point timer ring 73 is rotated counterclockwise (as shown in FIGS. 7 and 10 and described below) sufficiently for ramped platforms 119 of ring 73 to engage with ramped platforms 86 of yoke 71, thereby pushing yoke 71 rearwardly and releasing cam 72 from the locked position.

The Timing Mechanism

Figure 12:
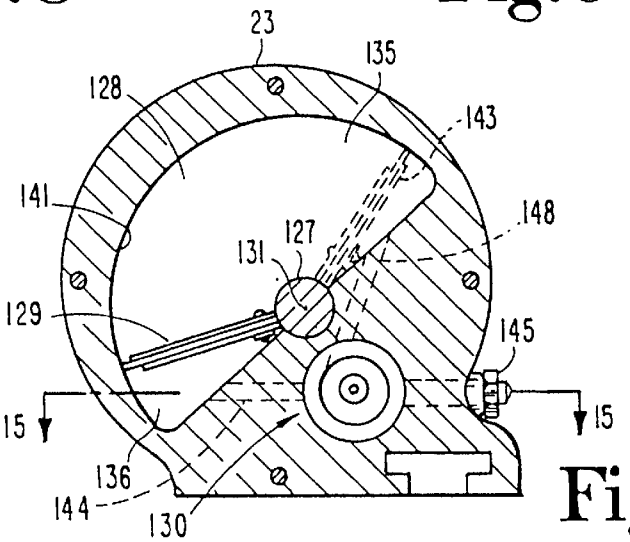
FIG. 12 is a side, cross-sectional view of the apparatus of FIG. 5 taken along the line 12—12 and viewed in the direction of the arrows.
Figure 13:
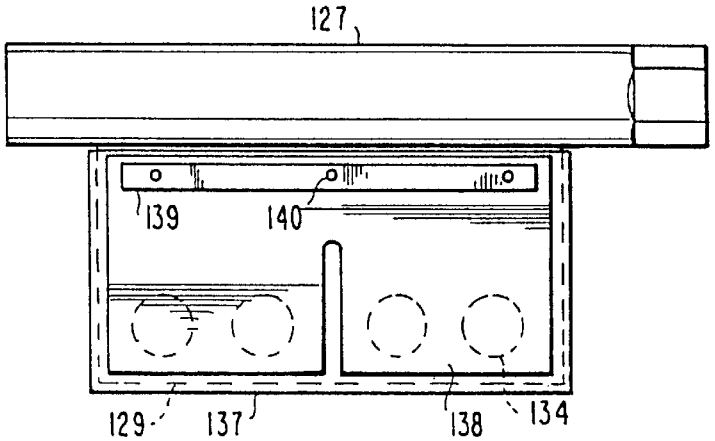
FIG. 13 is a plan view of the shaft and timing vane of the timing mechanism of the apparatus of FIG. 5.
Figure 14:
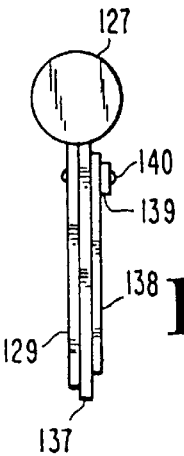
FIG. 14 is a side view of the shaft and timing vane of FIG. 13.
Figure 15:
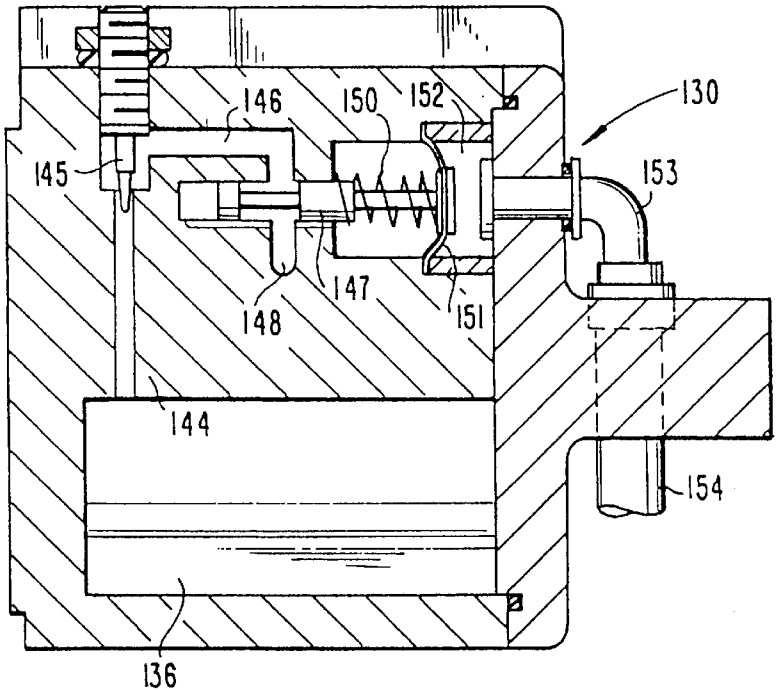
FIG. 15 is a cross-sectional view of a portion of the timing mechanism of the apparatus of FIG. 5, taken along the line 15—15 of FIG. 12 and viewed in the direction of the arrows.

Referring now to FIGS. 5 and 12 through 14, timing mechanism 53 includes timer chamber 128, timer shaft 127, timing vane 129, and a timer suspension valve system 130 (FIGS. 12 and 15). Timer chamber 128, defined by timer enclosure 23 and right end cap 25, has a constant width and constant radius and sweeps through an angle of approximately 180° about the axis 131 of timer shaft 127. Timing vane 129 is welded to shaft 127 and defines a number of flow holes 134. Shaft 127 is mounted in holes 132 and 133 of timer enclosure 123 and right end cap 25, respectively, to allow vane 129 to rotate within chamber 128. As viewed in FIG. 12, the potion of chamber 128 on the clockwise side of vane 129 is referred to herein as the cocking side 135 while the portion on the counterclockwise side of vane 129 is referred to as the timing side 136 of chamber 128. Timing vane 129 is adapted to act as a one-way valve between cocking side 135 and timing side 136 by the addition of a neoprene valve seal 137 and a leaf spring 138 to vane 129 on the timing side 136. A hold-down strip 139 with rivets 140 clamps vane 129, seal 137 and spring 138 sandwiched together. 14). As clamped to vane 129, seal 137 is sized to extend radially and to the sides slightly outwardly from vane 129 (as seen in FIG. 13) and to contact and seal against the interior walls 141 of timer chamber 128, thereby precluding fluid from flowing around the edges of vane 129 in either direction between cocking side 135 and timing side 136. Leaf spring 138 holds seal 137 against the side of vane 129, thereby covering holes 134 and precluding fluid from flowing therethrough. When vane 129 is pivoted clockwise (as viewed in FIG. 12) about axis 131, the fluid pressure acting through flow holes 134 and against seal 137 is sufficient to bend seal 137 away from vane 129 and against the bias of spring 138, thereby allowing fluid to flow from cocking side 135 to timing side 136. When vane 129 reaches its cocked position (at 143), spring 138 returns seal 137 to a sealing position against vane 129.

For vane 129 to be able to rotate counterclockwise to a timed out position (at 142), fluid must be permitted to flow from timing side 136 to clocking side 135. Referring to FIGS. 12 and 15, an outlet passage 144 leads from timing side 136 to an adjustable needle valve 145. The outlet 146 from needle valve 145 leads to diaphragm-operated valve member 147 of timer suspension valve system 130. When valve member 147 is open, fluid is allowed to flow from passage 146 through relief passage 148 to the cocking side 135 of vane 129. Valve member 147 is held in the normally open position by a spring 150 and is reciprocated between open and closed positions by pressure variations acting on the right side of diaphragm 151 within signal pressure chamber 152. Pressure chamber 152 is in communication through O-ring sealed, metal bulkhead tube fitting 153 which is connected to seat signal tube 154.

Looking at FIGS. 16 through 19, tube 154 extends into and around the front of toilet seat 17 and is connected there to a soft plastic sensing tube 155. The majority of the length of tube 154 is approximately, fixedly sealed in a recess defined in the underside of seat 17 between a shaped recess 160 and its connection to tube 155. Sensing tube 155 is set in soft, flexible caulking 156 in a formed recess 158 (FIG. 17) defined in the underside of seat 17 with a substantial portion extending below the lowest portion 157 of seat 17. When seat 17 is in the down or closed position substantially adjacent to bowl 12, and sufficient weight is placed upon seat 17 such as by a person sitting thereon, sensing tube 155 and the fluid volume contained therein are compressed, which compression is translated through signal tube 154 and back to pressure chamber 152 to exert a force against diaphragm 151 which pushed valve member 147 to the left (as viewed in FIG. 15), against the bias of spring 150, which in turn blocks fluid flow from passage 146 to relief passage 148. Despite the urging of timer power spring 77 to rotate shaft 127 and vane 129, fluid cannot flow from timing side 136 to cocking side 135 around vane 129 or through holes 134, and, with valve member 147 activated to block flow from passage 146 to relief passage 148, the countdown of timing mechanism 53 is temporarily suspended. As soon as weight is removed from atop seat 17 sufficient to allow valve member 147 to open, flow will resume past relief valve 145 and the timing sequence will continue.

In the preferred embodiment, timing mechanism 53 is adapted for an uninterrupted timing stroke of approximately four minutes. By appropriate design of the size of threaded needle valve 145 and its corresponding aperture, the timing stroke valve may be made adjustable as desired.

Figure 19:
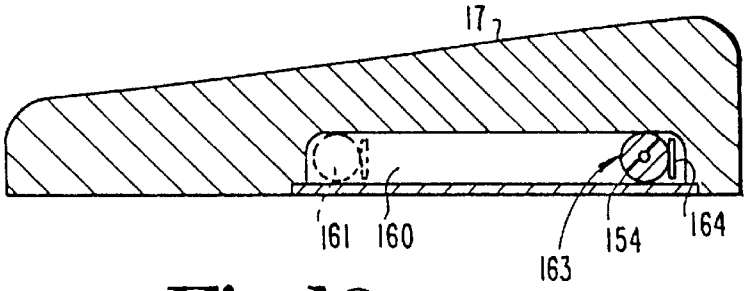
FIG. 19 is a perspective, partially fragmented view of scat signal tube 154 within shaped cavity 160 of toilet seat 17 of FIG. 16, taken along the line 19—19 and viewed in the direction of the arrows.
Figure 17:
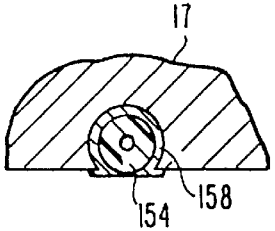
FIG. 17 is a cross-sectional view of seat signal tube 154 of FIG. 16, taken along the line 17—17 and viewed in the direction of the arrows.
Figure 18:
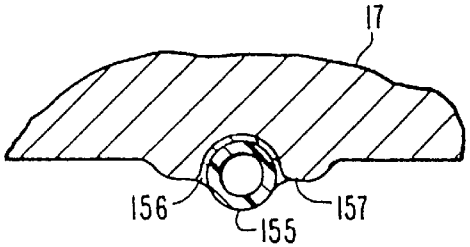
FIG. 18 is a cross-sectional view of sensing tube 155 of FIG. 16, taken along the line 18—18 and viewed in the direction of the arrows.
Figure 16:
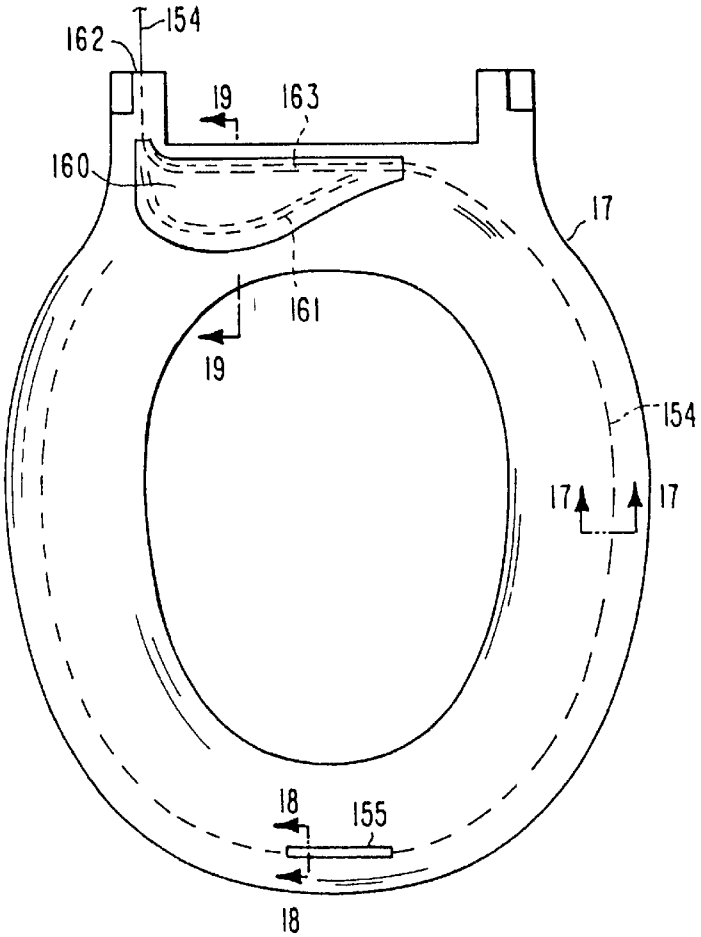
FIG. 16 is a bottom view of a toilet seat showing seat signal tube 154 of timer suspension valve system 130 of FIG. 15.

As shown in FIGS. 16 and 19, shaped cavity 160 is defined in the underside of seats 17 to provide for movement of seat signal tube 154 upon raising and lowering of seat 17. Tube 154 is freely slidable within cavity 160 before being fixed within its recess 158. When seat 17 is down, tube 154 is disposed in the position indicated at 161. When seat 17 is raised, the entry point 162 of seat 17 moves farther from tube fitting 153 at housing 11, and tube 154 is pulled to assume the position indicated at 163. A flat spring 164 (FIG. 19) is provided to constantly urge tube 154 to the seat down position at 161.

Summarizing the entire operation of apparatus 10, with both seat 17 and lid 18 in the closed portion as shown in FIG. 2, lid 18 and thereby shaft 15 may be rotated to an open position through an angle of approximately 95°. As a result: retarder spring 55 substantially unrestrictively rotates through chamber 57 to its open position at 67; J-shaped lower half 54 easily rotates through its chamber 58 until deformed against wall 67; primary cam 72 rotates timer ring 73 until cam platforms 105 engage shift pins 76 which moves primary cam 72 rearwardly and out of engagement with timer ring 73 and into engagement with teeth 90 of yoke 71, thereby locking primary cam 72, shaft 15 and lid 18 in the open position; rotation of timer ring 73 winds coil spring 77; and, rotation of timer ring 73, via pinion 126 and shaft 127, substantially unrestrictively rotates timing vane 129 through timer chamber 127 to the cocked position at 143. With no external weight or force being exerted to push seat 17 down, the weight of seat 17 alone is insufficient to compress sensing tube 155, diaphragm operated valve member 147 is in the open position due to spring 150, and fluid is free to flow from the timing side 136 of vane 129, past needle valve 145 and valve member 147, to the cocked side 135 of vane 129 to rotate through chamber 128, said rotation being induced by the unwinding force of timer power spring 77. At the end of the closing stroke of timing vane 129 through chamber 128, ramped platforms 119 of timer ring 73 engage platforms 86 of yoke 71 and push yoke 71 rearwardly, thereby disengaging teeth 90 from primary cam 72, which enables free rotation of cam 72 and lid 18. The stressed, J-shaped, lower half 54 of spring 55 rotates shaft 15 and lid 18 for enough for gravity to pull lid 18 down to its closed position. The rotation of lid 18 from the open to closed position is retarded by drag created by spring 55 moving through fluid-filled chamber 57.

When lid 18 is first lifted and locked into the open position, sitting on seat 17 or otherwise exerting a downward force thereon sufficient to compress sensing tube 155 and close valve member 147 will temporarily preclude the rotation of vane 129 through chamber 128, thereby suspending the countdown of timing mechanism 53.

If seat 17 and lid 18 are locked together by seat catch lever 40, they will both be held in the locked, open position by apparatus 10 and will be lowered together slowly by the action of retarding mechanism 51.

Alternative embodiments are contemplated for toilet facilities which have only a seat and do not have a lid or for facilities wherein the seat is inherently not pivotable. In these instances, shaft 15 may be locked to rotate with the described pivotable member and seat catch lever 40 may be connected, removed or disconnected as appropriate.

Referring now to FIGS. 20–51, there is shown an apparatus 200 for automatically pivoting a first member relative to a second member to which it is pivotally attached in accordance with the preferred embodiment of the present invention. As used herein, the two members may be pivotally or hingedly connected with each other, those two terms being used interchangeably herein. Further upon opening a first member, such as a toilet seat, a door or a gate, people often neglect to close such first member immediately after it's use. In such instances, apparatus 200 will operate to automatically "close" the first member back to its original position after passage of a predetermined period of time. In other applications of the present invention, the first member may be another type of object, such as a handle, flap or gate on a piece of machinery, and it may be pivoted, rotated, translated or moved, either manually or by the action of a mechanical device, about a pivot pin, hinge or other mechanical arrangement from a first position to a second position. After the passage of a predetermined amount of time, the first member is desired to automatically return to the first position, or perhaps to move to another, second position. The present invention is operable to effect such return or movement. For purposes of description herein, closing, returning or moving the first member refers to the pivoting, rotation, translation, or movement of the first member back to the first position or to another, second position. In addition, the first member may be moved from a first position to a second position in a particular path relative to another part to which it is mechanically attached, where such path may be linear, arcuate or irregular, and then be automatically returned to the first position or to another position, after passage of a predetermined amount of time. The present invention may likewise be used to provide such automatic return through the use of appropriate mechanical mechanisms including, but not limited to gears, cams and linkages.

Figure 20:
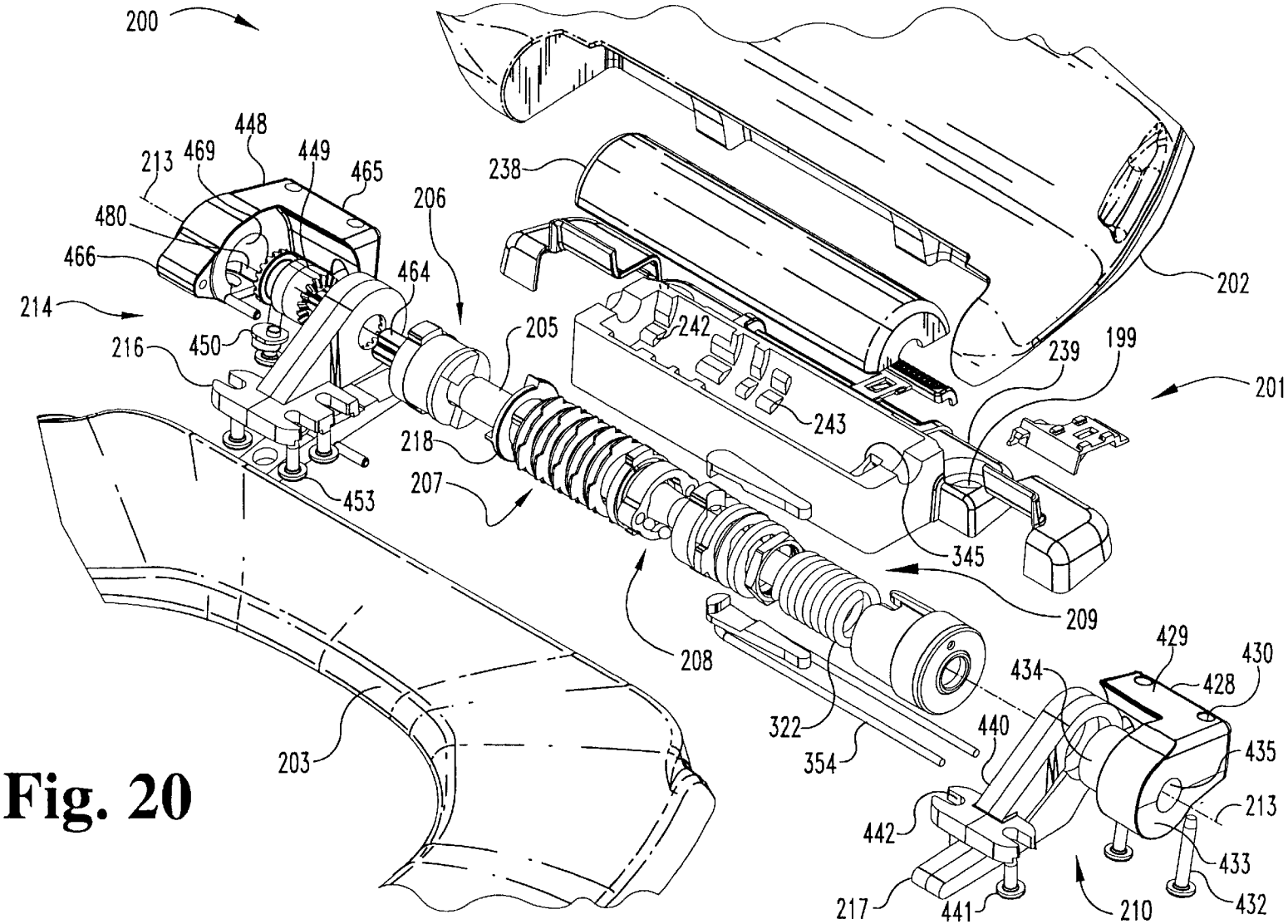
FIG. 20 is an exploded perspective view of an apparatus 200 for automatically pivoting a first member relative to a second member in accordance with the preferred embodiment of the present invention, and shown in use for pivoting a toilet bowl seat and lid.
Figure 21:
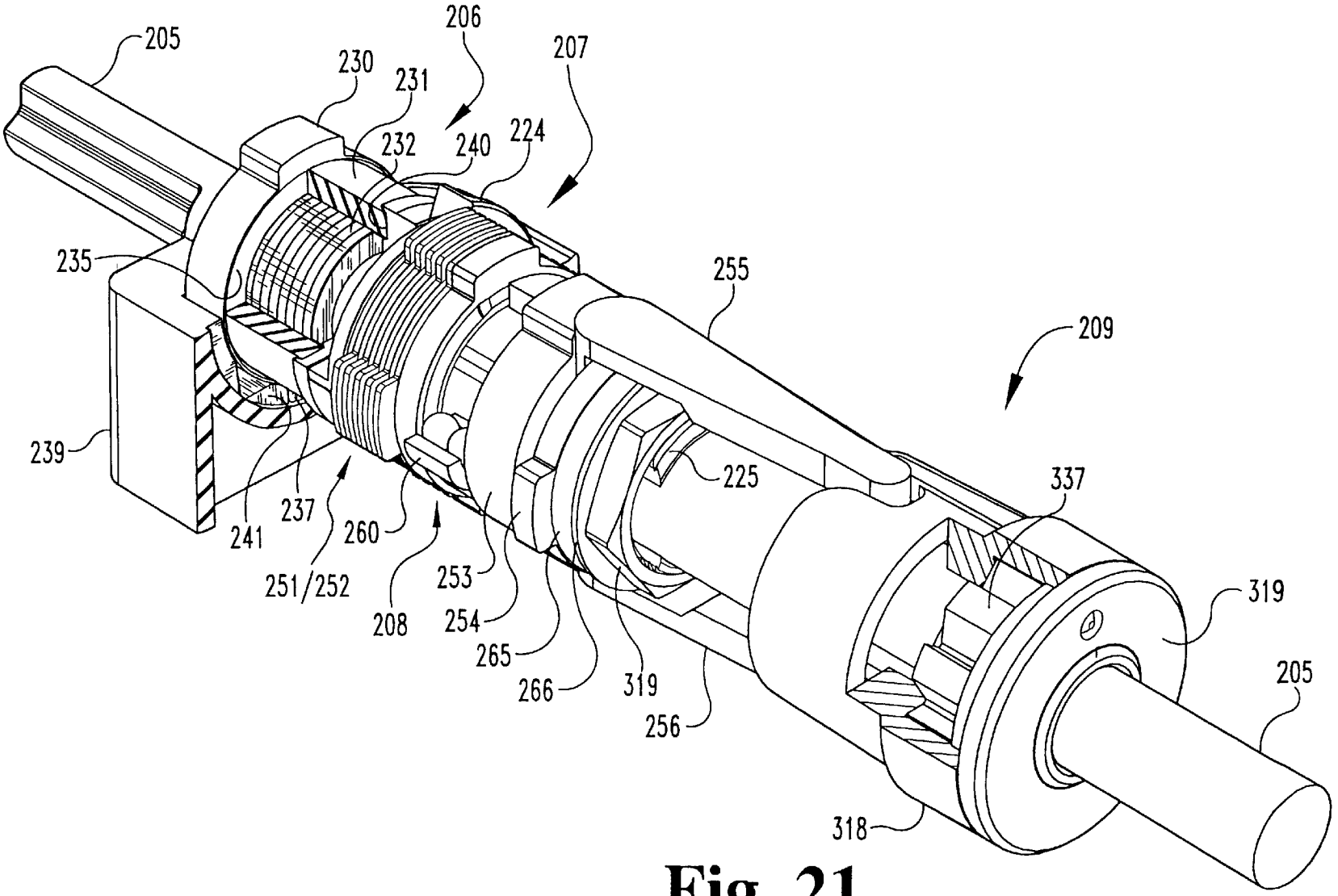
FIG. 21 is a perspective view of the torsion spring assembly 206, braking assembly 207, ball shift assembly 208 and damper rotor assembly 209 in a fully assembled condition on shaft 205 of apparatus 200 of FIG. 20. Spring clutch 322 is removed for clarity.

Referring to FIGS. 20 and 21, there is shown an apparatus 200 for automatically pivoting a first member relative to a second member to which it is pivotally attached, after a predetermined period of time has elapsed. The present embodiment is directed to one application of the present invention—a toilet lid 202 and/or seat 203 that is desired to automatically be closed after use, but only after a desired period of time has elapsed. Apparatus 200 includes a housing 201 which acts as a base for apparatus 200 and which is mountable to a toilet bowl (not shown) in a conventional manner such as by the use of threaded pins and wing nuts (not shown) engaged through holes 199 in housing 201. Apparatus 200 further generally includes five mutually interacting control systems that impinge on a shaft 205 that connects to lid 202 and/or seat 203; they are: a torsion spring assembly 206, a braking assembly 207, a ball shift assembly 208, a damper rotor assembly 209, and a timing interrupt assembly 210. Apparatus 200 also includes a lid select mechanism 214 that permits the user to engage apparatus 200 with either the lid 202 or the seat 203. For purposes of description, apparatus 200 will generally be described as being engaged and operable with only lid 202. Description will thereafter be provided about lid select mechanism 214 and its operation to engage apparatus 200 with either or both of lid 202 and seat 203.

Figure 22:
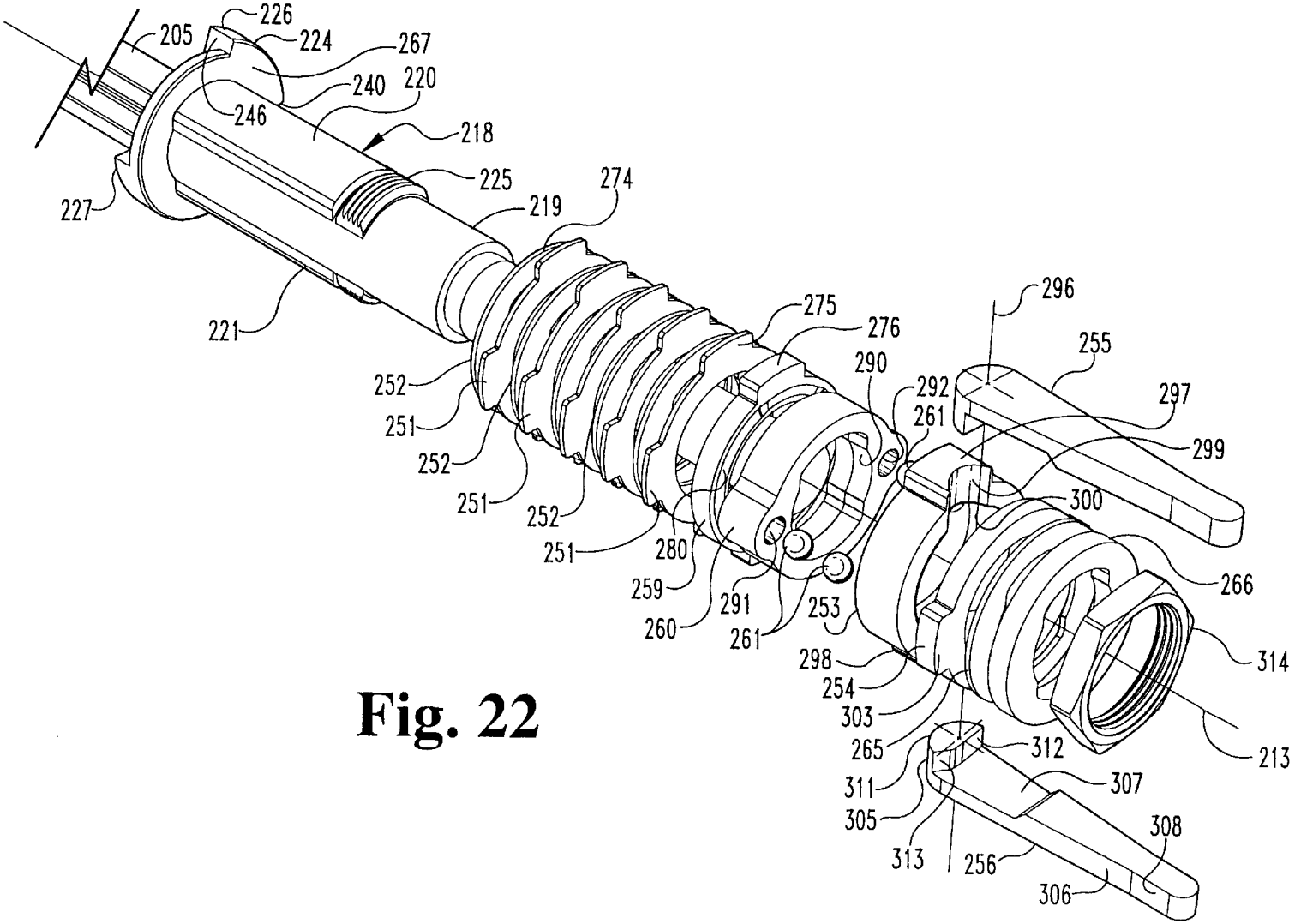
FIG. 22 is an exploded perspective view of shaft 205 braking assembly 207 and ball shift assembly 208 of apparatus 200 of FIG. 20.
Figure 23:
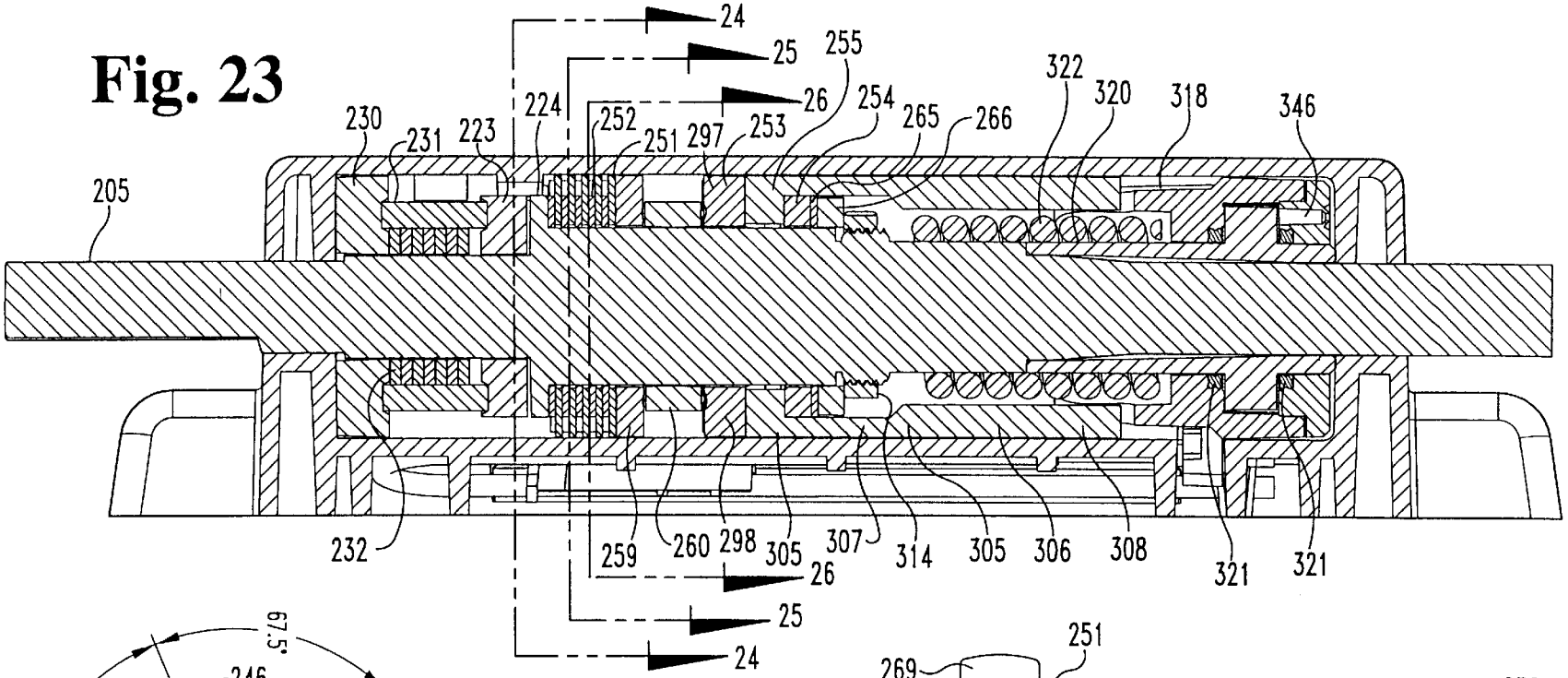
FIG. 23 is a side cross-sectional view of apparatus 200 of FIG. 20 shown in the fully assembled condition, the cross section taken through the axis of shaft 205.
Figure 24:
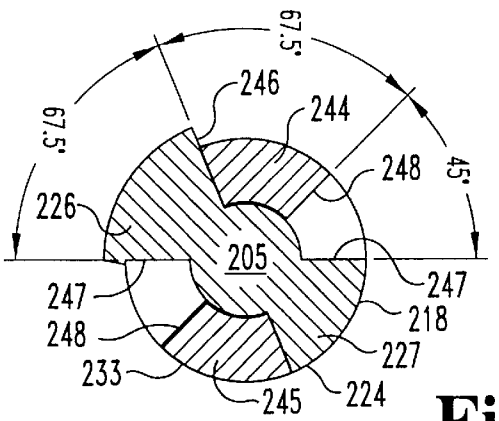
FIG. 24 is an end cross-sectional view of clutch/brake hub 218 and face dog engagement 224 of the apparatus 200 of FIG. 23 taken along the line 24—24 and viewed in the direction of the arrows.

Referring to FIGS. 20–24, shaft 205 extends through the left hinge member 216 (as viewed in FIG. 20) of seat 203 and lid 202, through all of assemblies 206–209, and through right hinge member 217 of seat 203. Shaft 205 includes a clutch/brake hub 218 (FIG. 22) which itself includes a generally cylindrical portion 219, a pair of diametrically opposed splines 220 and 221 and a face dog engagement 224. Hub 218 may be formed as a separate piece and slid telescopically over and fixed to shaft 205, or as in the preferred embodiment, hub 218 may be integrally formed with shaft 205 (FIG. 23). Threads 225 are defined at the right ends of splines 220 and 221. Face dog engagement 224 includes a pair of diametrically opposed, leftwardly extending face dogs 226 and 227, each of which extends through an angle of approximately 67.5 degrees. (FIG. 24).

Torsion Spring Assembly. Referring to FIGS. 20, 21, 23 and 27, torsion spring assembly 206 includes a spring case mounting 230, a rubber tube spring, 231, a plurality of anti-collapse rings 232 and a face dog engagement 233. Spring case mounting 230 is generally cylindrical with an annular recess 235 in its right face into which is received and fixed the left end of generally cylindrical tube spring 231. Spring case mounting 230 also includes a pair of diametrically opposed, radially outwardly extending posts 236 and 237. Housing 201 includes upper and lower housing halves 238 and 239, respectively, and each housing half 238 and 239 is shaped to receive the assembled set of assemblies 206–209 (as shown in FIG. 21) therein. Upper and lower housing halves 238 and 239 include a series of projections (as at 241 in FIG. 21 and 242 and 243 in FIG. 20, for example) that engage with certain of the components of assemblies 206–209 to prevent those components from rotating about shaft 205. For example, spring case mounting 230 sits within a complementary shaped portion of lower housing half 239, and a pair of projections (projection 241 shown in FIG. 21 and projection 242 shown in FIG. 20) engage with the downwardly extending post 237, thereby preventing spring case mounting 230 from rotating within lower housing half 239. Similarly shaped and positioned projections are provided in upper and lower housing halves 238 and 239 to engage with other projections of the various components of assemblies 206–209, and such structures are herein identified by noting whether such components are held against rotation about shaft 205 by housing halves 238 and 239.

Figures 27, 34:
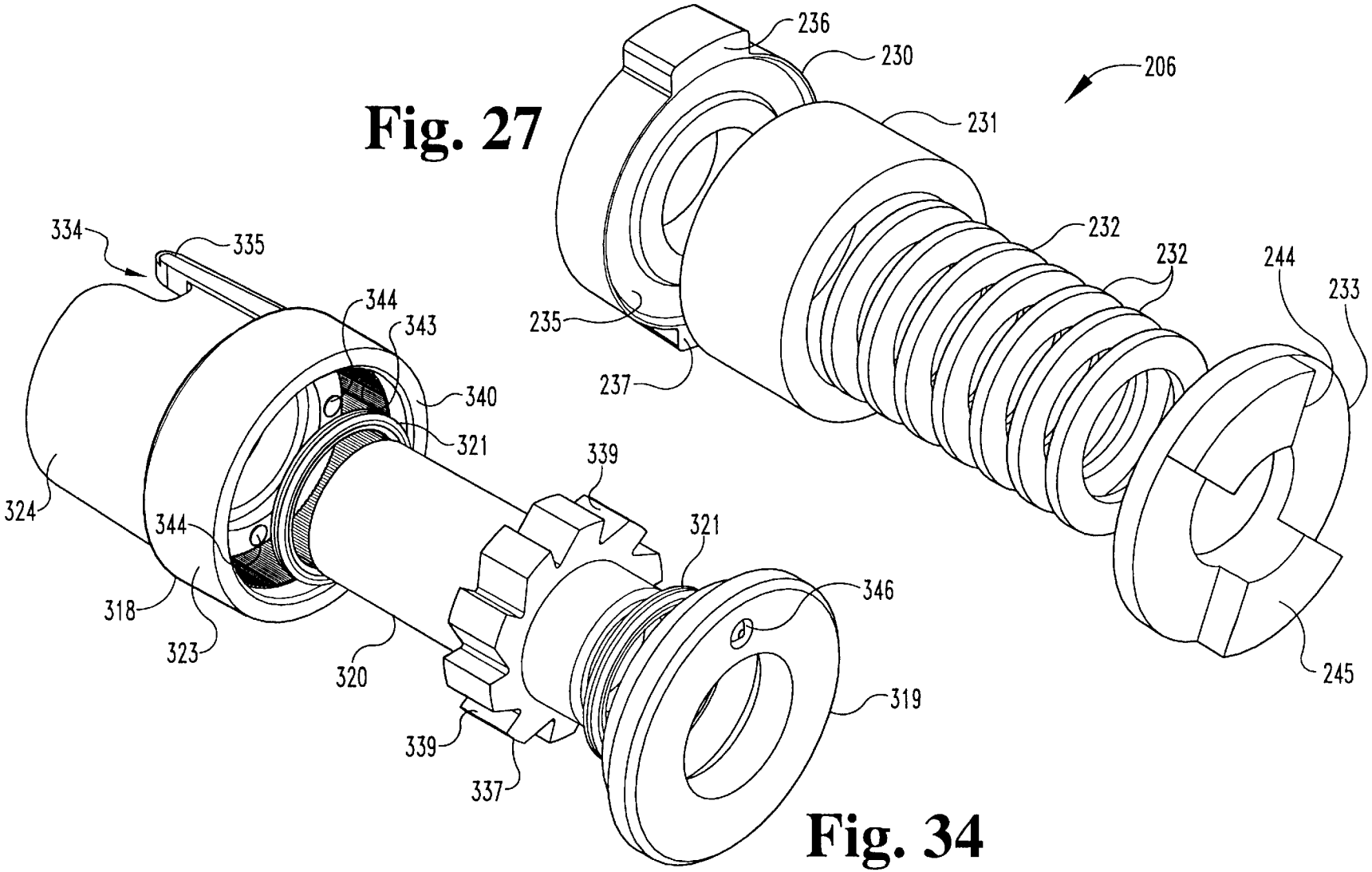
FIG. 27 is an exploded perspective view of the torsion spring assembly 206 of the apparatus 200 of FIG. 20.
FIG. 34 is a perspective view of damper/rotor assembly 209 (without spring clutch 322) of apparatus 200 of FIG. 20.

Returning to the description of torsion spring assembly 206, face dog engagement 233 is generally cylindrical and has on its left side an annular recess 240 (FIG. 21) into which is received and bonded the right end of tube spring 231. The plurality of anti-collapse rings 232 are disposed loosely around shaft 204, between spring case mounting 230 and face dog engagement 233 and within tube spring 231. In the present embodiment, there are seven anti-collapse rings 232 and they are made of plastic. Face dog engagement 233 further includes a pair of diametrically opposed, rightwardly extending face dogs 244 and 245, each of which extends through an angle of approximately 67.5 degrees. (FIGS. 24 and 27). The seven rings 232 and face dog engagement 233 are free to rotate about shaft 205, but face dogs 244 and 245 engage through a portion of their rotation with face dogs 226 and 227 of face dog engagement 224 of hub 218. More specifically, in the lid down position (with lid 202 in the down or closed position), shaft 205 and consequently hub 218 and its face dog engagement 224, and face dog engagement 223, are in the positions shown in FIG. 24. When lid 202 is raised, shaft 205 and hub 218 are pivoted (counterclockwise as viewed in FIG. 24) until the leading edges 247 of face dogs 226 and 227 engage with the trailing edges 248 of face dogs 244 and 245 (about 45 degrees of rotation). Further lifting of lid 202, and thus counterclockwise pivoting of shaft 205 and hub 218, rotates face dog engagement 233, via engagement of face dogs 226 and 227 with face dogs 244 and 245 through a spring-cocking angle. Because spring case mounting 230 is fixed against rotation within housing 201, tube spring 231 is twisted, thereby maintaining on shaft 205 a torque that urges lid 202 back toward the lid down position. That is, tube spring 231 urges shaft 205 to rotate clockwise back to the lid down position shown in FIG. 24. Tube spring 231 is preferably rubber with a 60 Shore A hardness. The floating anti-collapse rings 232 enable tube spring 231 to twist about shaft 205 without collapsing inwardly.

Figure 40:
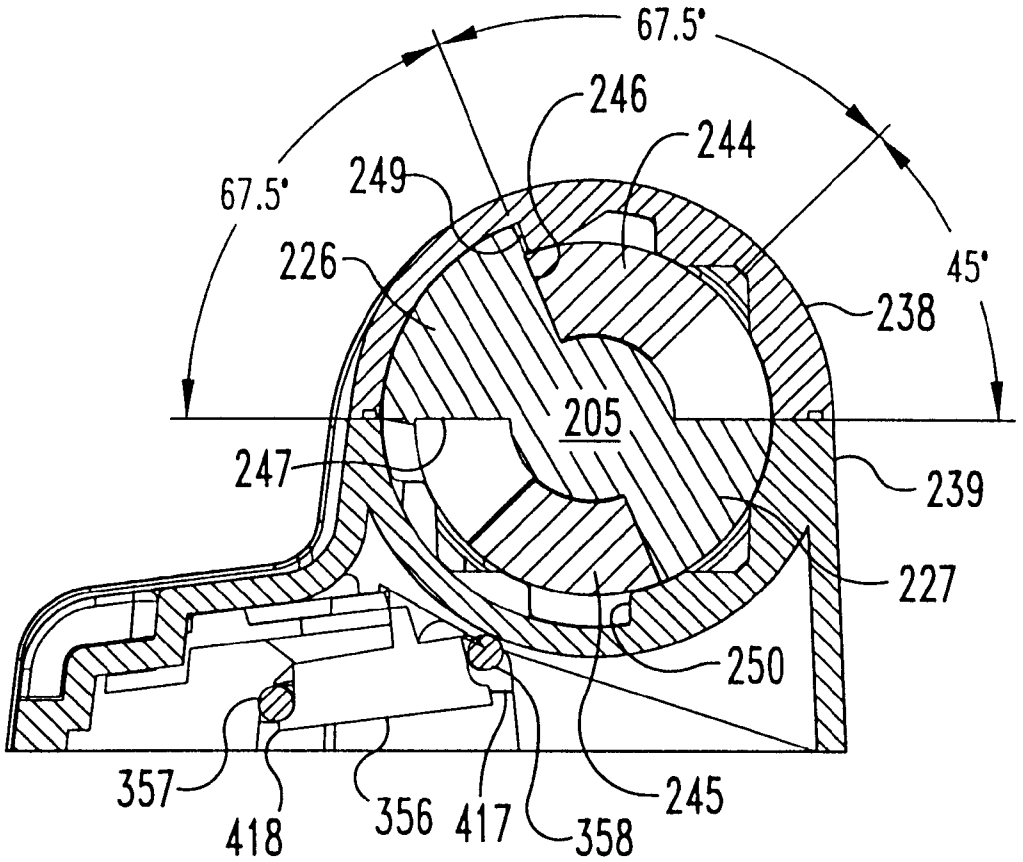
FIG. 40 is another view of clutch/brake hub 218 and facedog engagement 224 of the apparatus 200 of FIG. 24 and shown mounted within upper and lower housing halves 238 and 239.
Figure 41:
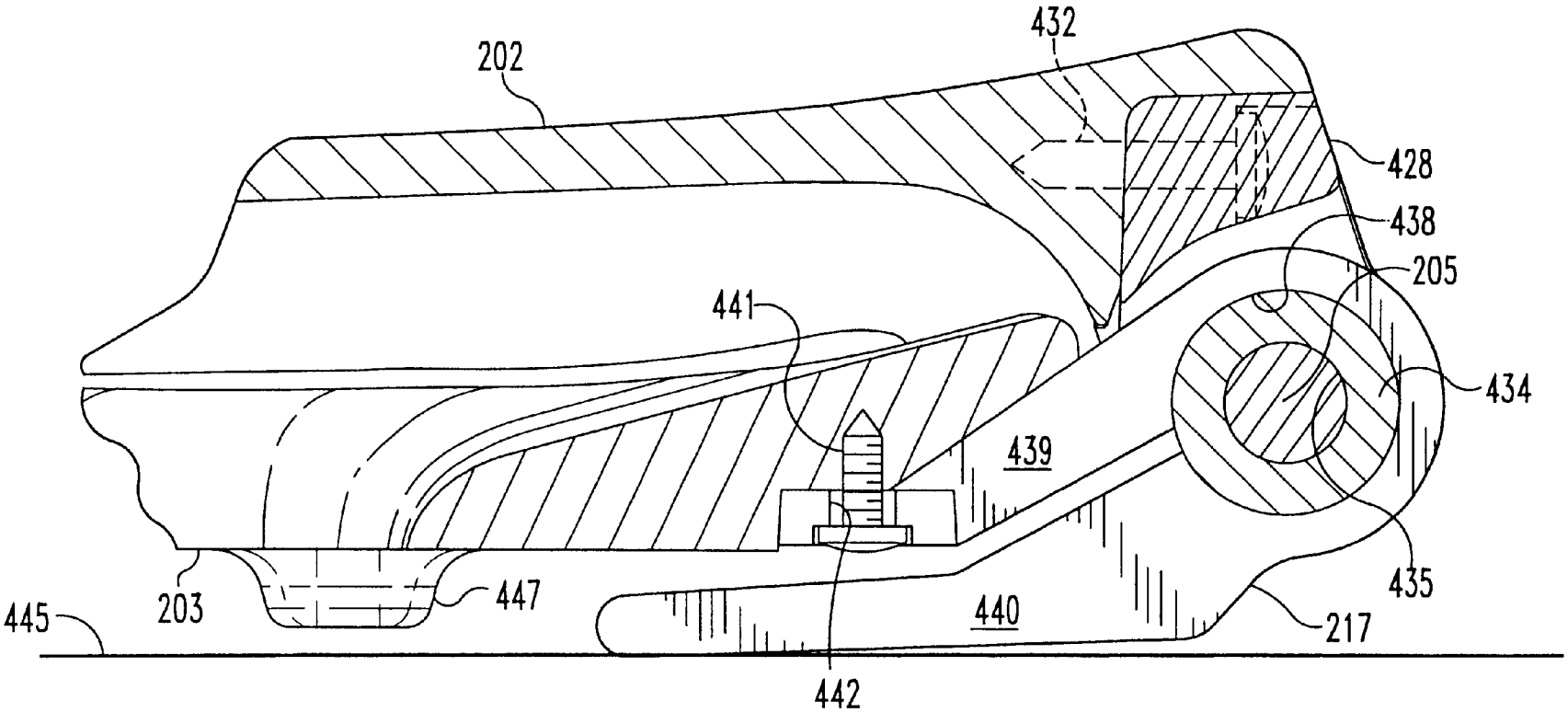
FIG. 41 is a sign cross-sectional view of apparatus 200 of FIG. 39 taken along the lines 41—41 and viewed in the direction of the arrows.

Face dog engagement 224 at face dog 226 extends radially outwardly farther, along with face dog 226, from central shaft 205, than the rest of face dog engagement 224, as shown in FIGS. 24 and 40. Upper and lower housing halves 238 and 239 include inwardly extending projections that define first and second stop surfaces 249 and 250. Stop surface 249 is positioned within upper housing half 238 so that, when shaft 205 is in the lid down position, trailing edge 246 of face dog 226 engages stop surface 249, thereby precluding shaft 205 and the lid connected therewith from rotating any further clockwise (as viewed in FIG. 40). In the preferred embodiment, stop surface 249 is positioned so that trailing edge 246 engages or would engage stop surface 249 with lid 202 being approximately two degrees below horizontal. Stop surface 250 is positioned within lower housing half 239 so that shaft 205 and the lid 202 connected therewith can pivot counterclockwise (as viewed in FIG. 40) no further than 100 degrees from the lid down position. That is, in practice, the toilet lid cannot be pivoted farther than 2 degrees past the lid down position and cannot pivoted from the lid down position to the lid up position any greater than 100 degrees from the lid down position.

Braking Assembly and Ball Shift Assembly. Referring to FIGS. 20–23, 25 and 26, and primarily FIG. 22, braking assembly 207 includes an alternating series of static, die cast zinc brake plates 251 and rotating, paper-based Phenolic brake disks 252, a brake pressure plate 253, a right pressure plate 254, and a pair of brake levers 255 and 256. The ball shift assembly 208 includes a shift plate 259, a ball carrier 260 and two pairs of ball bearings 261 (only three bearings 261 shown). Another Phenolic brake disk 265 and zinc spacer 266 are also provided. All of these plates 251, 253, 254, and 259., the disks 252 and 265, the ball carrier 266, and the spacer 265 are received coaxially over clutch/brake hub 218 at splines 220 and 221, that is, between the right face 267 of face dog engagement 224 and threads 225, and in the order shown in FIG. 22.

Figure 25:
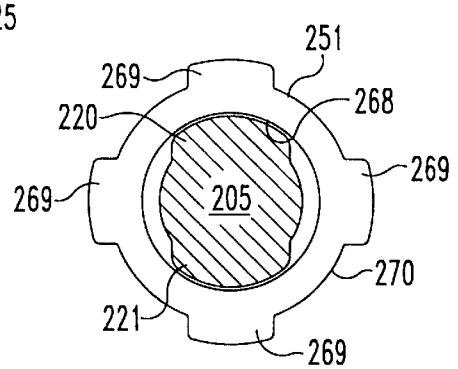
FIG. 25. is an end cross-sectional view of a brake plate 251 and shaft 205 of the apparatus 200 of FIG. 23 taken along the lines 25—25 and viewed in the direction of the arrows.
Figure 26:
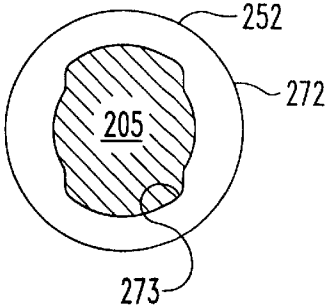
FIG. 26 is an end cross-sectional view of a brake plate disk 252 and shaft 205 of the apparatus 200 of FIG. 23 taken along the lines 25—25 and viewed in the direction of the arrows.

In the preferred embodiment, there are five each of the static brake plates 251 and five each of the rotating brake disks 252, all assembled in a coaxial and alternating arrangement, as shown in FIG. 22. As shown in FIGS. 22 and 25, brake plates 251 are each generally annular with a round inner edge 268 and a round outer edge 270, except for four, spaced-apart, radially outwardly projecting posts 269 that engage with projections in upper and lower housing halves 238 and 239. Brake plates 251 are thereby held against rotation about shaft 205 by housing halves 238 and 239. The diameter of round inner edge 268 of each brake plate 251 is slightly larger than the diametrical dimension of clutch/brake hub 218 at splines 220 and 221, and brake plates 251 may therefore slide axially along clutch/brake hub 218 as braking action is applied and released. Referring to FIGS. 22 and 26, rotating brake disks 252 are generally annular. The outer edges or peripheries 272 of rotating brake disks 252 may vary; in the present preferred embodiment, the peripheries 272 are round. The inner edges 273 of brake disks 252 are shaped complementary to, but slightly larger than clutch/brake hub 218 along splines 220 and 221. Brake disks 252 are thereby constrained to rotate with shaft 205 and clutch/brake hub 218, but like brake plates 251, may slide axially along clutch/brake hub 218 as braking action is applied and released. From left to right, the first brake disk 274 is positioned coaxially next to the right face 267 of face dog engagement 224, followed by a brake plate 251, then a brake disk 252, a brake plate 251 and so on until the rightmost brake plate 275.

Positioned to the right side of the rightmost brake plate 275 is shift plate 259 which is generally cylindrical with a pair of diametrically opposed, radially outwardly extending posts 276 and 277. Like posts 236 and 237, posts 276 and 277 engage with projections in upper and lower housing halves 238 and 239, and hold shift plate 259 against rotation about shaft 205. Referring to FIGS. 22, 23 and 28, the right face of shift plate 259 defines an annular groove or recess 280. Groove 280 has a generally arcuate cross-section. From points at least somewhat counterclockwise (as viewed in FIG. 28) of the midline 281 of shift plate 259, and preferably from points 282 about 50 degrees counterclockwise of midline 281, and through to points 283 approximately 70 degrees clockwise of midline 281, groove 280 has a depth (at 284), in the present embodiment of approximately 0.011 inches. The values given herein for part dimensions and angles relate to the present, preferred embodiment. It is to be understood that such values may vary as desired to achieve a particular manner of operation or to configure apparatus 200 for a particular application. In this embodiment, for example, with the groove depths as described, the outer diameter of shift plate 259 is approximately 1.25 inches (not counting posts 276 and 277), and the inner diameter is approximately 0.77 inches. Through approximately eight degrees clockwise of points 283 and the 0.011 inch deep section 284, groove 280 ramps out to points 285 where it is only 0.006 inches deep. Clockwise of points 285 for at least 22 degrees and preferably 52 degrees, groove 280 is a constant 0.006 inches deep (at 287). For the remaining 8 degrees, groove 280 ramps back in to 0.011 inches deep. Groove 280 with sections 284 and 287 need only be formed on one side, but it may be formed identically on the other (left) side as well. In this manner, shift plate 259 may be more easily and reliably assembled as it is then reversible and cannot be assembled incorrectly.

Referring to FIGS. 22, 23, 29 and 30, ball carrier 260 is generally cylindrical except that its inner surface 290 is shaped complementary to, but slightly larger than clutch/brake hub 218 along splines 220 and 221. Ball carrier 260 is thereby constrained to rotate with shaft 205 and clutch/brake hub 218, but like brake plates 251, ball carrier 260 may slide axially along clutch/brake hub 218 as braking action is applied and released. Also, ball carrier 260 defines a pair of diametrically opposed holes 291 and 292. The axes of holes 291 and 292 are parallel to, are equidistant from and lie in the same plane as axis 213 of shaft 205 when ball carrier 260 is coaxially positioned on hub 218 and over splines 220 and 221. The diameter of holes 291 and 292 are equal and are slightly greater than the diameter of the four equally sized steel ball bearings 261 (only three shown). The axial width 293 of ball carrier 260 is slightly less than twice the diameter of a ball bearing 261 so that when a pair of ball bearings 261 is loaded into each one of the holes 291 and 292, a portion of each bearing protrudes from each side of ball carrier 260, as shown in FIG. 30.

Referring to FIGS. 22, 23, and 31, brake pressure plate 253 is generally cylindrical with a pair of diametrically opposed, radially outwardly extending posts 297 and 298. Like posts 236 and 237, posts 297 and 298 engage with projections in upper and lower housing halves 238 and 239 that hold brake pressure plate 253 against rotation within housing 201, but permit a limited amount of axial movement thereof. A pair of diametrically aligned arcuate recesses 299 are defined in brake pressure plate 253, on one side thereof and primarily in upper and lower posts 297 and 298, as shown. Only one recess 299 is shown in FIG. 22, but brake pressure plate 253 is symmetrical about a horizontal plane, and thus the lower recess (not shown) in post 298 is identical to the recess in post 297. Recesses 299 of posts 297 and 298 define a vertical axis of rotation 296 about which pivot levers 255 and 256, as described herein. The inner surface 300 of brake pressure plate 253 is cylindrical with a diameter slightly larger than the diametrical dimension of clutch/brake hub 218 at splines 220 and 221, and brake pressure plate 253 may therefore slide axially relative to clutch/brake hub 218 as braking action is applied and released, and shaft 205 may rotate freely therein. On the left face 301 of brake pressure plate 253 is defined an annular recess or groove 302 that is identical to groove 280 of shift plate 259, except that the depth of groove 302 is constant at approximately 0.011 inches. It should be understood that the variable depth groove 280 of shift plate 259 could be formed instead on the left face 301 of brake pressure plate 253 and the groove defined on shift plate 259 could be of constant depth, or there could be one groove of varying depth on just one of, or both of, shift plate 259 and brake pressure plate 253 so long as the relative distance between shift plate 259 and brake pressure plate 253, measured along the axis of holes 291 and 292, varies by approximately 0.005 inches, or a similar desired amount, as described relative to the angles described and relating to FIG. 28.

Disposed to the right of brake pressure plate 253 is right pressure plate 254 which, like brake pressure plate 253, is configured with diametrically opposed, outwardly extending posts 303 (one shown) that engage with projections in upper and lower housing halves 238 and 239 to hold brake pressure plate 253 against rotation within housing 201. Brake pressure plate 253 has a circular inner surface with a diameter slightly larger than the diametrical dimension of clutch/brake hub 218 at splines 220 and 221, so that shaft 205 and hub 218 may freely rotate within plate 259. To the right of right pressure plate 254 is a Phenolic brake disk 265 and a zinc spacer 266, both of which have inner surfaces shaped complementary to splined hub 218 so that disk 265 and spacer 266 are constrained to rotate with shaft 205.

Referring to FIG. 22, brake levers 255 and 256 are identical (not mirror images) with each other. Referring then to just one of the levers, lever 256 is shaped as shown with a head 305 and an elongated leg 306. Head 305 projects upwardly at generally a right angle from leg 306, toward axis 213 and into the pocket defined between brake pressure plate 253 and right pressure plate 254, and within arcuate recess 299. The portion 307 of leg 306 a certain distance to the right of head 305 is sufficiently thin to enable leg 306 to extend to the right of head 305 and radially outside of right pressure plate 254, Phenolic brake disk 265 and spacer 266 with sufficient clearance for lever 256 to pivot about axis 296 of recesses 299. (See FIG. 23) At its right most end, lever 256 defines a rotor engagement post 308. Head 305 generally defines an arcuate, recess-engaging surface 311, a lever rest surface 312 and, to one side of rest surface 312, a cam surface 313.

In assembly, brake plates 251, brake disks 252, shift plate 259, ball carrier 260, with ball bearings 261, brake pressure plate 253, right pressure plate 254, brake disk 265, and spacer 266 all coaxially are sandwiched together on clutch/brake hub 218, with the heads 305 of levers 255 and 256 positioned in their respective recesses 299, these parts all being held thereat by nut 314 which is threadedly engaged with splines 225, as shown in FIG. 21.

Damper/rotor assembly. Referring to FIGS. 20, 21, 23 and 32–35, damper/rotor assembly 209 generally includes a rotor casing 318, a rotor casing end cap 319, a rotor 320, seals 321, and a spring clutch 322. Rotor casing 318 is generally cylindrical and essentially comprises a main rotor housing 323 and extended skirt 324. Skirt 324 extends leftwardly (as viewed in FIG. 34) from main rotor housing 323 and defines a pair of diametrically opposed slots 334. On the clockwise side of each slot 334 (as viewed in FIG. 34), skirt 324 defines an axially thickened region 335 that increases the contact area between rotor casing 318 and levers 255 and 256, which helps ensure that levers 255 and 256 are properly engaged when rotor casing 318 rotates. Rotor casing 318 has an inner cylindrical wall 325 that essentially separates main rotor housing 323 from skirt 324. On one side of inner cylindrical wall 325, main rotor housing 323 defines inner cylindrical recesses 326, 327 and 328, each of successively larger diameters. On the other side of inner cylindrical wall 325, skirt 324 defines an inner, generally cylindrical cavity 329 sized for receipt of one end of spring clutch 322 therein. A rotor control arm 330 extends downwardly and offset from central axis 331 of casing 318 (and of axis 213 when assembled). An arcuate recess 332 is defined on the backside 333 of rotor control arm 330.

Referring to FIGS. 32–35, rotor 320 is a generally cylindrical member defining an axial passageway 336 and a radially extending rotor element 337. Passageway 336 is sized to receive shaft 205 therein and to permit rotor 322 to rotate freely upon shaft 205. The outer diameter of rotor 320 is substantially identical with the outer diameter of cylindrical portion 219 of clutch/brake hub 218 so that when rotor 320 is received onto the right end of shaft 205, the left end of rotor 320 butts up against the right end of cylindrical portion 219 at joint 338. Rotor element 337 defines a series of circumferentially spaced notches 339. Inner seal 321 is positioned within recess 326 and rotor 320 is received through the right end 340 (FIG. 34) of rotor casing 318 until rotor element 337 is seated within recess 327 of casing 318, and outer seal 321 is then placed within recess 328. End cap 319 is then positioned within the remainder of recess 328 and held thereat by appropriate means such as a pressure fit. Seals 321 may be any appropriate seal such as a quad ring. A primary rotor cavity is thereby created among and between rotor 320, rotor casing 318 and end cap 318. The space of such primary rotor cavity, consisting primarily of clearances and notches 339, is filled with a silicone polymer or similar material that exhibits dilatant rheological properties such as Dow Corning's Q2-3233 Bouncing Putty. This dilatant compound provides a resistive torque that varies in proportion with the load applied. For example, in the present embodiment, with lid 202 in the lid opened position or nearly in the lid opened position, and with the lid being urged to the lid down position substantially only by the torque applied by torsion spring assembly 206, the dilatant compound offers sufficient resistive torque to enable the operation of apparatus 200 to permit a desired rate of decent of lid 202. As lid 202 pivots farther down, with or without seat 203 connected for descent therewith, and the load applied to shaft 205 increases (due to an increasing moment arm), the sheer applied to the dilatant compound increases and the resistive torque offered by the dilatant compound increases generally proportionately—resulting in a fairly constant and unchanging rate of descent. A vent port 346 is provided in end cap 319 for permitting the pressure within the rotor cavity to remain ambient. Rotor casing 318 is further provided with a series of axially aligned grooves 343 defined in recess 327, and a series of bosses 344 defined upon the structure of casing 318 between recesses 326 and 327. Notches 339, grooves 343, bosses 344 and the various other clearances are designed to control the flow of the dilatant compound and to stabilize performance of rotor 320 within rotor casing 318. Rotor casing 318 is free to rotate several degrees upon shaft 205 and within upper and lower housing halves 238 and 239, but the rotation of casing 318 is limited by control arm 330 which extends down through a specially sized slot 345 defined in lower housing half 239 (FIG. 20), the further function of which will be described herein.

Figure 35:
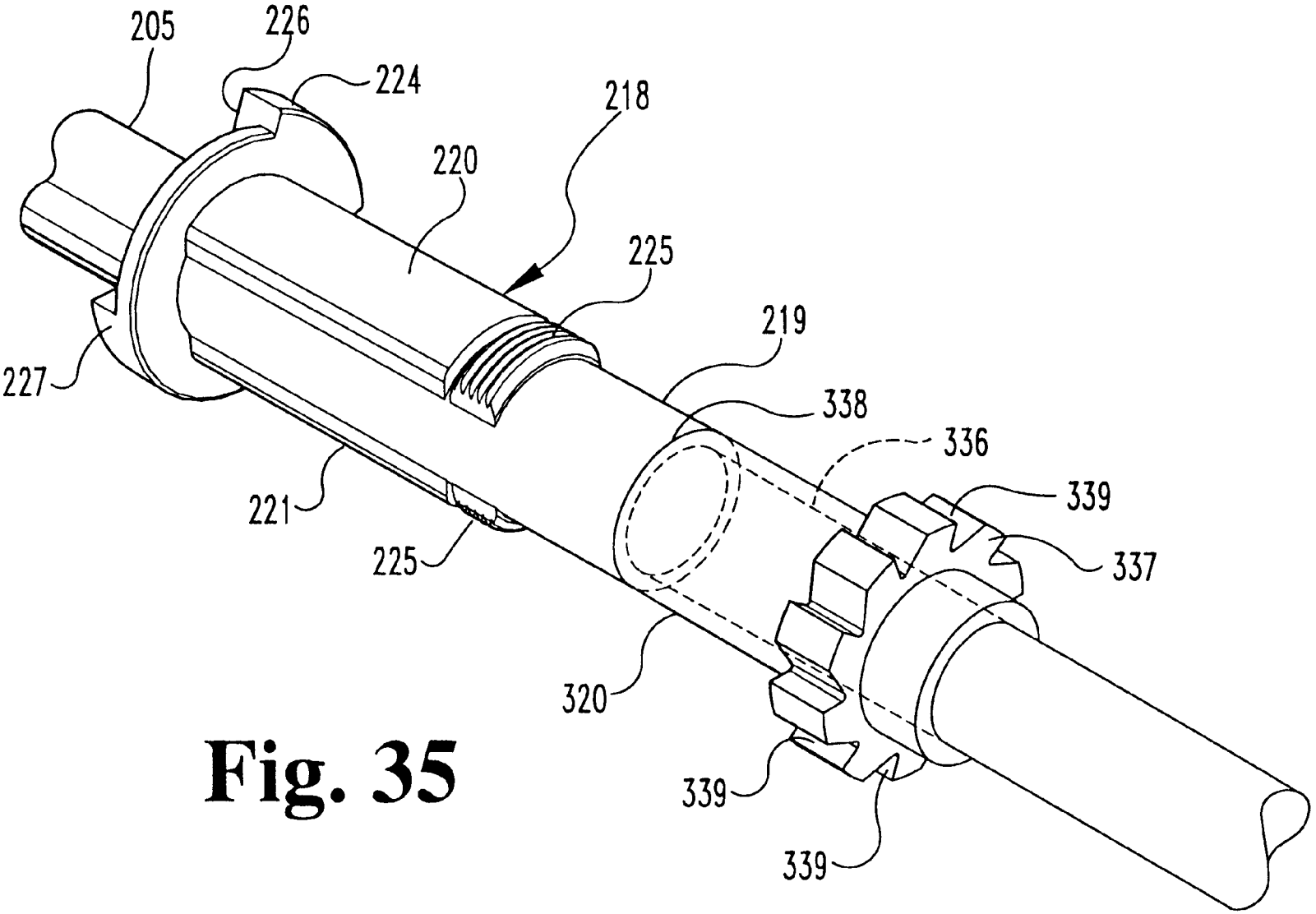
FIG. 35 is a perspective view of shaft 205 and rotor 320 of apparatus 200 of FIG. 21.
Figure 36:
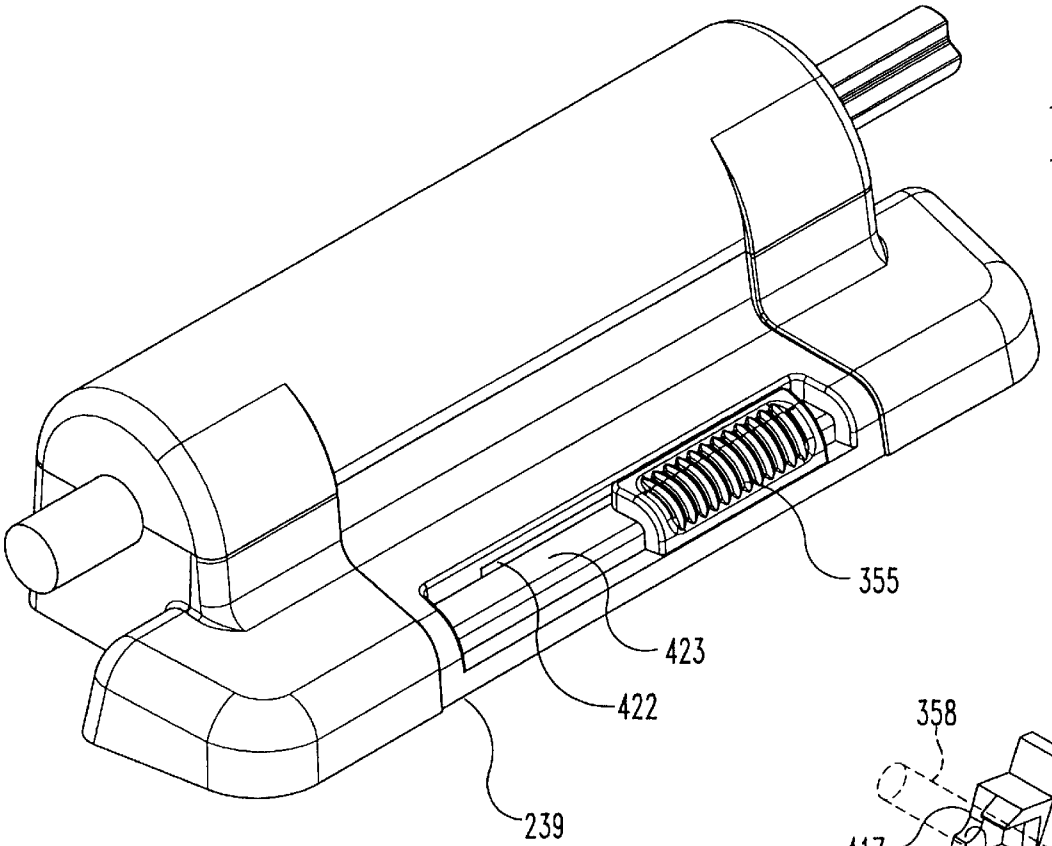
FIG. 36 is a rear perspective view of apparatus 200 of the present invention in the fully assembled condition.
Figure 37:
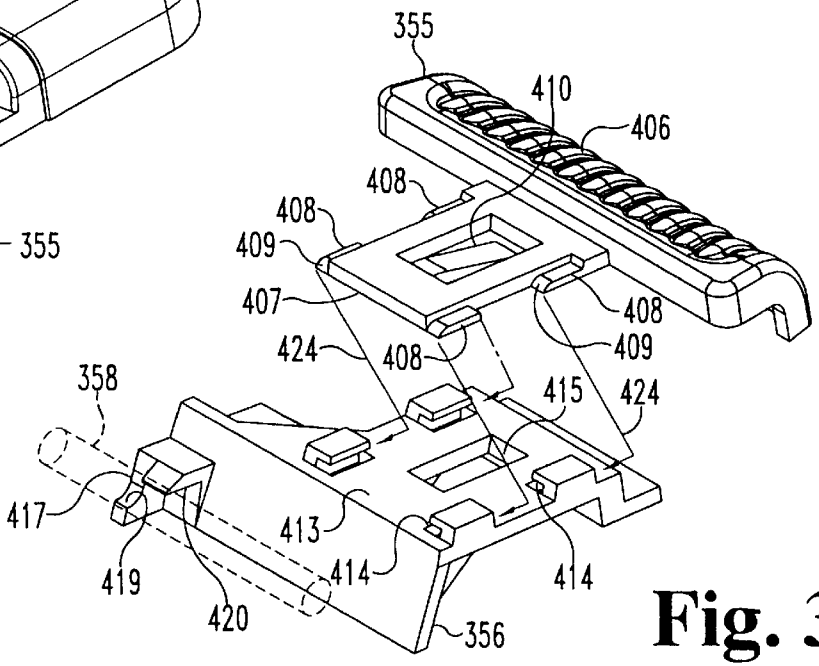
FIG. 37 is an exploded view of the timer adjust slide 355 and spring spacer 356 of the apparatus 200 of FIG. 20.

Spring clutch 322 is a standard spring-metal spring sized for a fairly close fit over both cylindrical portion 219 of clutch/brake hub 218 and rotor 322 when hub 218 and rotor 320 are assembled as shown in FIG. 35, with spring clutch 322 extending between threads 225 and rotor element 337 (see FIG. 23). Spring clutch 322 spirals in the direction shown in FIG. 20, and the composition and dimensions of spring clutch 322 are chosen so that, as positioned around cylindrical portion 219 and rotor 320, shaft 205 and hub 218 may rotate clockwise (as viewed in FIG. 20) relative to rotor 320 and inside of spring clutch 322, which action will tend to unwind spring clutch 322, and shaft 205 and hub 218 can freely rotate relative to rotor 320. Conversely, counterclockwise rotation of shaft 205 and clutch/brake hub 218 (as viewed in FIG. 20) relative to rotor 320 will tend to wind spring clutch 322, whereupon spring clutch 322 will bind upon hub 218 and rotor 320 and cause hub 218 and rotor 320 to rotate together as a unit.

Figure 38:
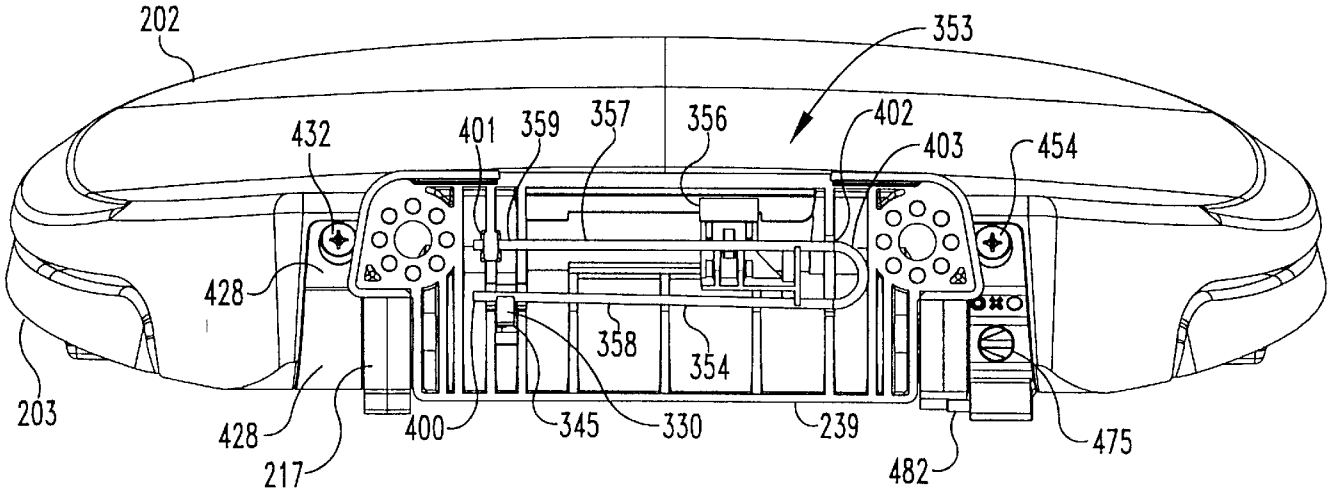
FIG. 38 is a bottom view of the apparatus 200 of FIG. 20, and showing apparatus 200 in the fully assembled condition and with lid 202 and seat 203 in the lid up position.
Figure 39:
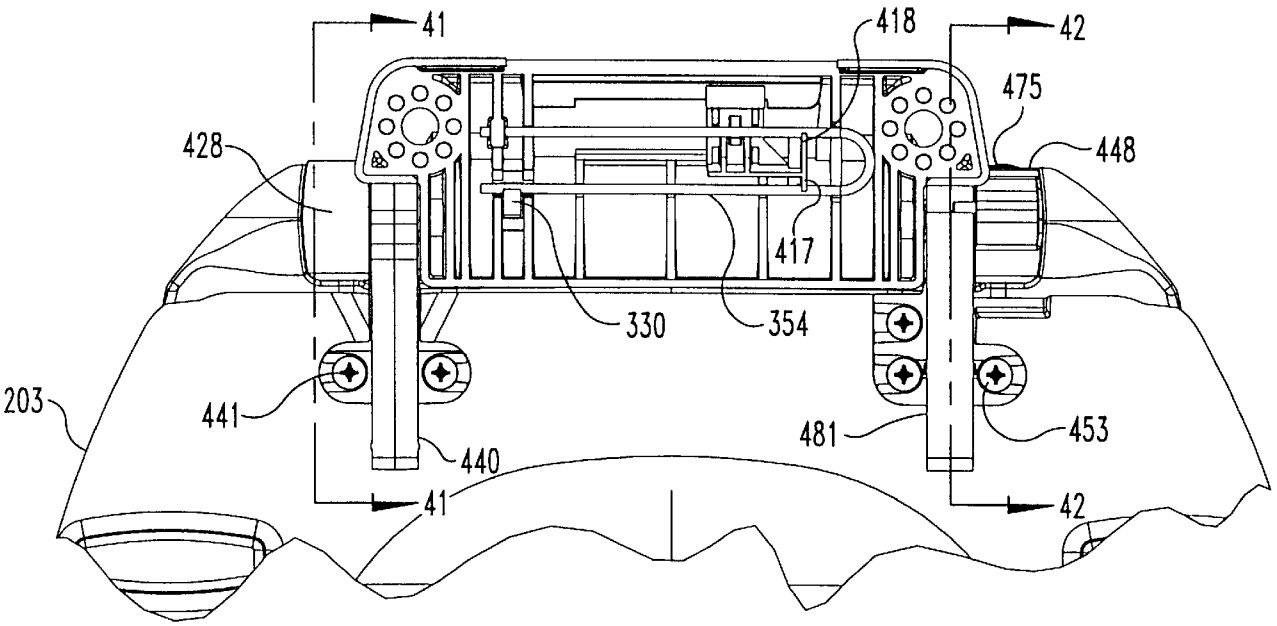
FIG. 39 is a bottom view of the apparatus 200 of FIG. 38 and showing lid 202 and seat 203 in the lid down position.

Referring now to FIGS. 20, 32, 33 and 36–40, there is shown the timer assembly 353 (FIG. 38) for varying the time delay before lid 202 and/or seat 203 begins its/their primary descent, as effected by apparatus 200. Operationally incorporated with rotor control arm 330 of rotor casing 318, timer assembly 353 includes counterbalance spring 354, timer adjust slide 355, and spring spacer 356. Spring 354 is generally U-shaped having a first anchor leg 357 and a second adjust leg 358. Spring 354 is mounted in corresponding structure in the bottom of lower housing half 239, as shown in FIG. 38, with the outboard end of anchor leg 359 lodged through as lot (not shown) defined in structure (at 401) on the underside of lower housing half 239. An appropriately shaped recess (at 402) in the underside structure of lower housing half 239 is sized to receive the U-shaped end 403 of spring 354. The outboard end of adjust leg 400 is received within the arcuate recess 332 of rotor control arm 330 which extends downwardly through slot 345 of lower housing half 239. FIG. 39 shows timer assembly 353 in the lid down position wherein rotor control arm 330 is in the rest (forward most) position and spring 354 is in the relaxed position, which is also when lid 202 of assembly 200 is all the way down and there is no torque being applied to rotor casing 318 to rotate it against the bias of spring 354. When a torque is applied to rotate rotor casing 318 about axis 213 due to a descending lid 202 and/or seat 203, control arm 330 is moved rearwardly, against the bias of adjust leg 358. The amount of resistive force exerted by spring 354 upon rotor control arm 330 varies with the length of adjust leg 358. That length is adjustable by sliding the timer adjust slide 355 which is located at the back of lower housing half 239.

More particularly, the time delay function of lid 202 as controlled by apparatus 200 is variable. This is accomplished by varying the effective length of adjust leg 358 from its engagement with rotor control arm 330 and to the right thereof, as viewed in FIG. 39, and such varying of the effective length of adjust leg 358 is accomplished with timer adjust slide 355 and spring spacer 356. Slide 355 includes a finger contact portion 406 and spacer connection bracket 407 extending therefrom. Bracket 407 includes four locking tabs 408, each of which having a ramp 409 at the forward end thereof. Connection bracket 407 also includes a centrally located, rearwardly and slightly downwardly extending locking tab 410 that is somewhat resilient to enable it to be bent and engage with a corresponding locking opening.

Spring spacer 356 has a main platform 413 and has four upwardly and inwardly extending brackets that each define a slot 414 that is sized to snugly receive a corresponding one of the ramped locking tabs 408 of timer adjust slide 355. Platform 413 further includes a central, rectangular opening 415 sized and positioned relative to slots 414 to receive the central locking tab 410 of timer adjust slide 355. Spring spacer 356 further defines forward and rearward spring engagement brackets 417 and 418, respectively. Bracket 417 includes an arcuate ledge 419 and a hood 420 that is offset from ledge 419, and spring engagement bracket 418 has similar, although mirror-imaged structure on the opposite side of spring spacer 356 (see FIGS. 39 and 40). This structure permits spring spacer 356 to easily be manipulated between and connected with anchor leg 357 and adjust leg 358 so that each of legs 357 and 358 extends between ledge 419 and hook 420 of a corresponding bracket 418 and 417, respectively, as shown in FIGS. 37–40. Adjust slide 355 is positioned by extending bracket 407 through an elongate slot 422 in the back of lower housing half 239, whereby finger portion 406 is slidably received and free to reciprocate within a laterally extending slide opening 423 in lower housing half 239. Spring spacer 356 is then connected with timer adjust slide 355 by bringing platform 413 up against spacer connection bracket 407 so that ramped locking tabs 408 are brought against platform 413, offset from slots 414, and then by sliding timer adjust slide 355 relative to spring spacer 356 so that the leading ramps 409 slide underneath the corresponding slots 414 until central tab 410, which has been bent nearly in the same plane as connection bracket 407, snaps into central opening 415, as shown by assembly guide arrows 424.

Referring to FIGS. 20, and 38–47, the assembly for operationally connecting apparatus 200 with either or neither of toilet lid 202 and toilet seat 203 comprises lid select mechanism 214, and the assembly for suspending the timing operation of apparatus 200 while someone is sitting on seat 203 comprises timing interrupt assembly 210. Referring primarily to FIGS. 20, 38, 39 and 41, interrupt assembly 210 includes right hinge member 217 and right hinge cover 428. Hinge cover 428 is generally L-shaped with one arm 429 defining apertures 430 through which extend screws 432 to fixedly connect hinge cover 428 with lid 202. The other arm 433 of generally L-shaped hinge cover 428 defines an inwardly extending axle stub 434 and further includes a cylindrically shaped opening 435 that extends all the way through arm 433 and its axle stub 434.

Right hinge member 217 defines a round opening 438, the inner diameter of which is substantially identical to the outer diameter of axle stub 434. In assembly, right hinge member 217 is rotatably mounted with right hinge cover 428 whereby axle stub 434 is received within round opening 438, and the right end of shaft 205 extends into opening 435 and is free to rotate therein. Similarly, right hinge member 217 and seat 203 fixedly connected therewith, can rotate freely about axle stub 434. Right hinge member 217 is split from opening 438, thus defining a seat mounting arm 439 and a brake activation arm 440. Mounting arm 439 is fixedly connected with seat 203 by appropriate means such as screws 441 that extend through apertures 442 in mounting arm 439. The size, shape and configuration of hinge member 217 is created so that, when seat 203 is in the down position, resting atop the toilet bowl 445, brake activation arm 440 touches the top of toilet bowl 445 and axle stub 434 can freely rotate within circular opening 438 of right hinge member 217. However apparatus 200 provides for suspension of the time delay sequence as well as outright braking the descent of lid 202 when someone sits upon seat 203. That is, when a person sits on seat 203, the added weight deflects seat mounting arm 439 downwardly toward brake activation arm 440 and, because brake activation arm 440 is contacting the top of toilet bowl 445, mounting arm 439 and activation arm 440 pinch together which clamps right hinge member 217 around axle stub 434 and prevents right hinge cover 428, and consequently lid 202 from rotating. If lid 202 is engaged with shaft 205 via lid select mechanism 214, the timer delay sequence of apparatus 200 is suspended, as well. As soon as the person gets up from seat 203, right hinge member 217 returns to its unclamped position, and right hinge cover 428 and lid 202 are again free to rotate relative to right hinge member 217. Apparatus 200 may be constructed in at least two ways to allow for the added braking deflection when someone sits on seat 203. In one construction, in the seat down position (FIG. 41) seat 203 is not completely down, but is supported a slight distance above bowl 445 by brake activation arm 440. As a result, the seat support bumpers 447 do not contact bowl 445 in the seat down position when no one is sitting on seat 203. Another construction contemplates bumpers 447 making contact with, and to some extent supporting bowl 445 in the seat down, unoccupied position, but contemplates that bumpers 447 are resilient enough to permit added deflection of seat 203 when a person sits on it, thereby deflecting seat mounting arm 439 and pinching arms 439 and 440 together.

Figure 42:
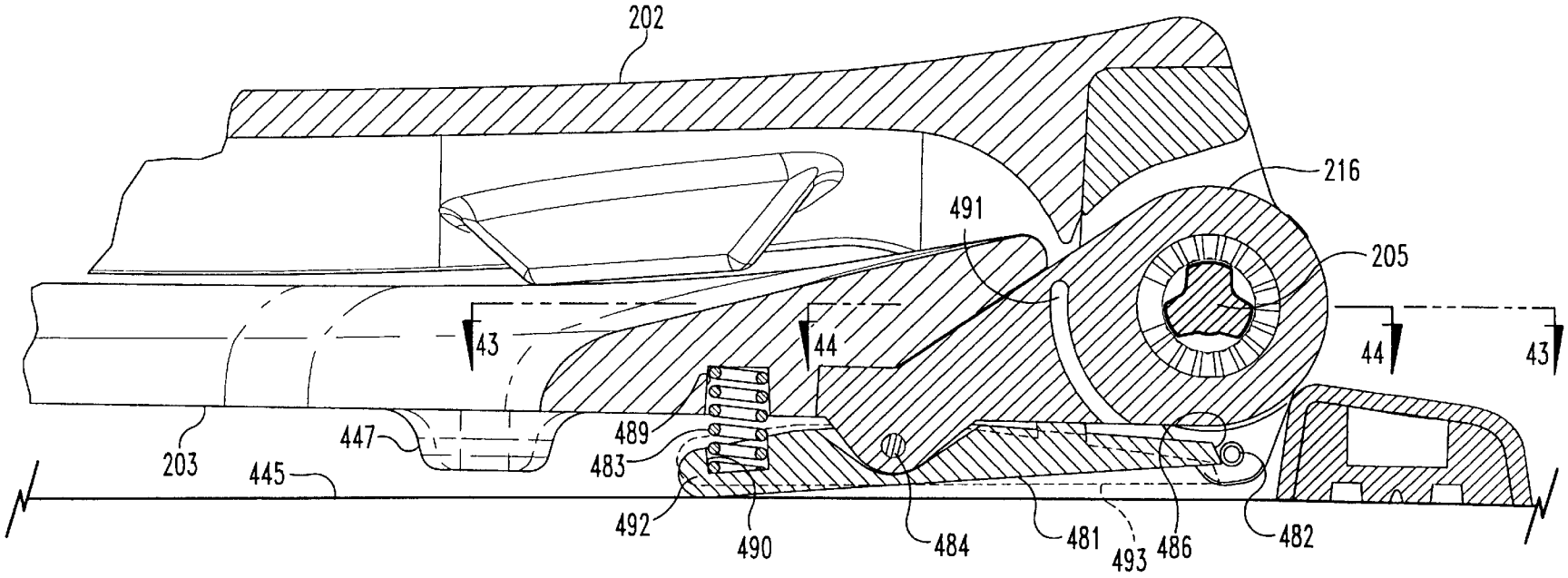
FIG. 42 is a sign cross-sectional view of apparatus 200 of FIG. 39 taken along the lines 42—42 and viewed in the direction of the arrows.
Figure 43:
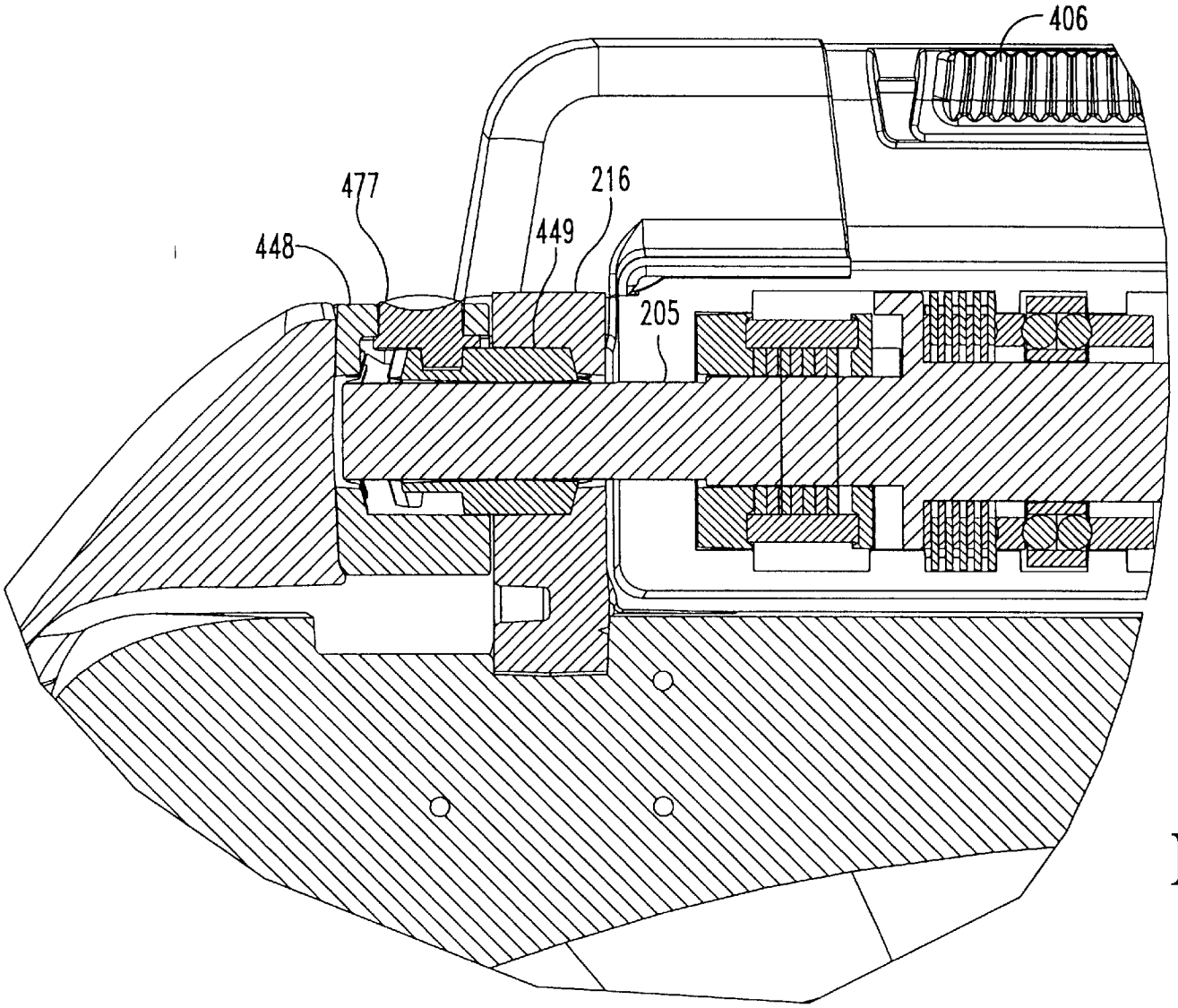
FIG. 43 is a top cross-sectional view of apparatus 200 of FIG. 42 taken along the lines 43—43 and viewed in the direction of the arrows.
Figure 48:
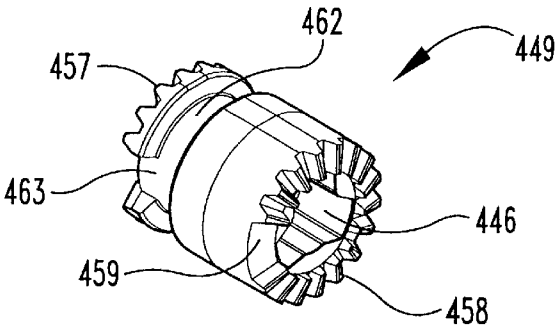
FIG. 48 is a perspective view of hub select 449 of the apparatus 200 of FIG. 1.

Referring primarily to FIGS. 20, 38, 39, and 42–49, lid select mechanism 214 includes left hinge member 216, left hinge cover 448, hub select 449, and dial select pin 450. Like right hinge member 217 and right hinge cover 428, left hinge member 216 fixedly connects with seat 203 by appropriate means such as screws 453, and left hinge cover 448 fixedly connects with lid 202 by appropriate means such as screws 454. As shown in FIG. 48, hub select 449 is a generally cylindrical member having an axial passageway 446 and radially extending splines 457 and 458 at opposing ends, respectively. At least one spline 458 is missing from one end of hub select 449, leaving a gap 459. Just inwardly from the opposite end, hub select 449 defines a circumferential recess 462. And, at the end of hub select 449 with splines 457, a section of hub select 449 is removed to create a gap 463, the surface of which has the same radial dimension as that of circumferential gap 462. Axial passageway 446 has a non-circular, generally triangular cross-section (FIGS. 42 and 48). The size and cross-sectional shape of axial passageway 446 is complementary with the left end 464 of shaft 205, and that end 464 of shaft 205 is received within axial passageway 446. Hub select 449 may slide axially along end 464, but is constrained to rotate as a unit with shaft 205. Like right hinge cover 428, left hinge cover 448 is generally U-shaped, the rear arm 465 having apertures for receipt of screws to connect left hinge cover with lid 202. The forwardly extending arm 466 of left hinge cover 448 defines a hole 469 that is sized and shaped to coaxially receive hub select 449 for rotation therein about axis 213. All the way inside and to the left of hole 469, left hinge cover 448 defines a series of radial splines 470 that are sized, shaped, and positioned to engage with splines 457 of hub select 449 when hub select 449 is axially received within hole 469. Splines 470 include one spline 471 that is fatter than all the rest of splines 470 and which precisely engages with a gap (not shown) of splines 457 of hub select 449, that gap being similar to gap 459 (FIG. 48) of splines 458. This structure makes hub select 449, and consequently shaft 205, engagable with left hinge cover 448 and consequently lid 202, in only one Mutual angular relationship. That is, fat spline 471 and the complementary sized gap (not shown) in splines 457 may only align and permit engagement between shaft 205 and lid 202 when they are in the same, desired orientation. In the present embodiment, this alignment causes lid 202 to be lockable with shaft 205 only when lid 202 is in the lid down position, as will be described herein.

Similarly, left hinge member 216 defines a hole 473 (FIG. 44) that, on the left side of hinge member 216, is sized and shaped to coaxially receive hub select 449 therein, and on the right side of left hinge member 216, is sized just large enough to freely receive the left end 464 of shaft 205 therein. Between the differing diameter sections of hole 473, left hinge member 216 defines a series of radial splines 474 that are sized, shaped, and positioned within hole 473 to engage with the splines 458 of hub select 449. And as with splines 470 of left hinge cover 448, splines 474 also define a fat spline (not shown, but like fat spline 471 of left hinge cover splines 470) that is sized, shaped, and positioned to engage with gap 459 of hub select 449 so that left hinge member 216, and consequently seat 203, are only able to engage with hub select 449, and consequently shaft 205, in one angular position. As with left hinge cover 448, that single position is with seat 203 in the lid down position.

Figure 51:
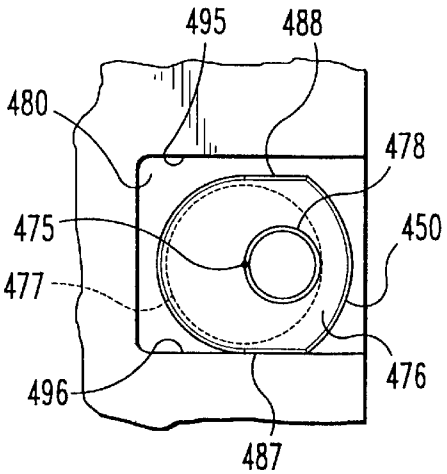
FIG. 51 is a view of the dial select pin 450 of FIG. 49 taken along the lines 51—51 and viewed in the direction of the arrows.
Figure 50:
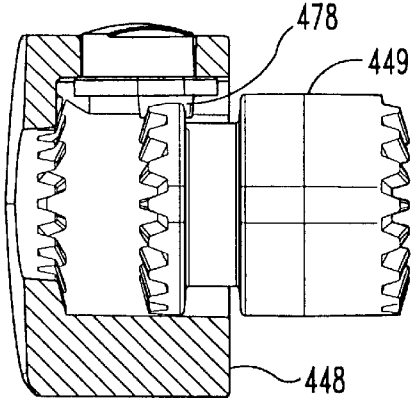
FIG. 50 is a top cross-sectional showing hub select 449 being loaded into left hinge cover 448.
Figure 47:
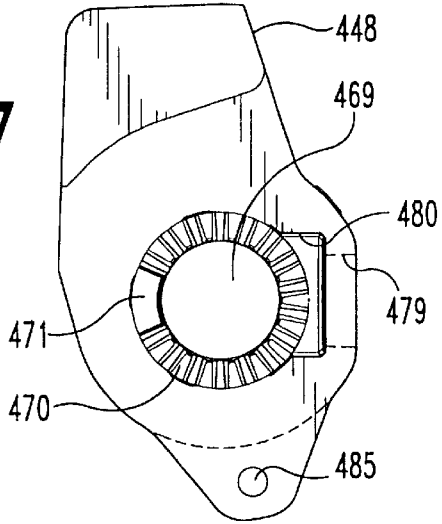
FIG. 47 is a side view of left hinge cover 448 of the apparatus 200 of FIG. 1, and showing the arrangement of splines 470.

The position of hub select 449 along shaft 205 and axis 213, and within holes 469 and 473, is determined by a dial select pin 450 which has a central, generally circular flange 476 (FIGS. 49 and 51), a dial post 477 and a boss 478. Flange 476 is generally circular about a central rotation axis 475 except that flange 476 extends slightly farther in one radial direction to create a pair of parallel and opposing stop surfaces 487 and 488. Dial post 477 extends from one side of flange 476 and is coaxially about axis 475. Boss 478 extends from the opposite side of flange 476 a distance roughly equal to or just less than the depth of circumferential recess 462 in hub select 449, and boss 478 is off set from axis 475, as shown in FIG. 51. Left hinge cover 448 defines a hole 479 and a generally rectangular recess 480 that are both in communication with hole 469 (FIG. 47 and 49), and hole 479 opens to the back of left hinge cover 448 when left hinge cover 448 and its connected lid 202 are in the lid down position, as shown in FIG. 39. The diameter of hole 479 is slightly greater than the outer diameter of dial post 477 so that dial post 477 may be received into and freely rotate within hole 479. Rectangular recess 480 defines a pair of opposing and parallel walls 495 and 496, and hole 479 is located slightly closer to wall 496 than to 495.

Figure 46:
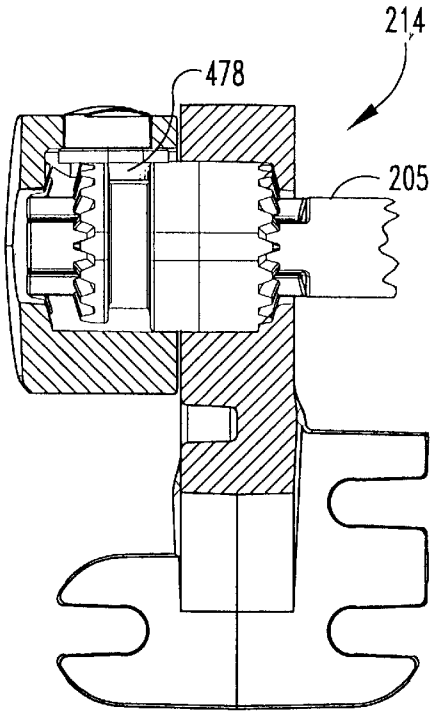
FIG. 46 is a top cross-sectional view of the lid select mechanism 214 of FIG. 44, and shown with hub select 449 adjusted to engage shaft 205 with seat 203.
Figure 45:
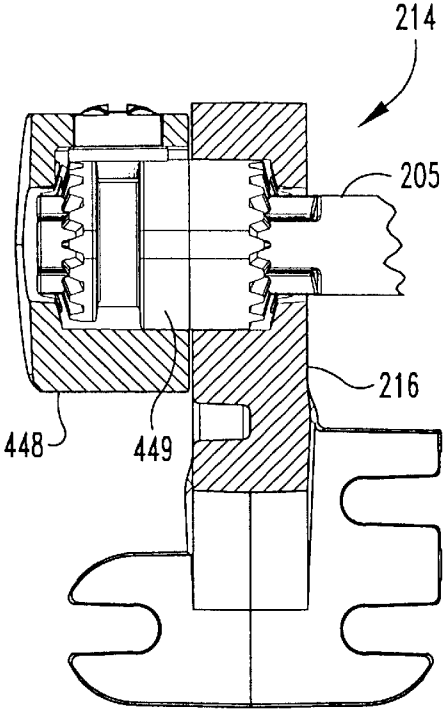
FIG. 45 is a top cross-sectional view of the lid select mechanism 214 of FIG. 44, and shown with hub select 449 in the idle position, engaging shaft 205 with neither lid 202 or seat 203.
Figure 44:
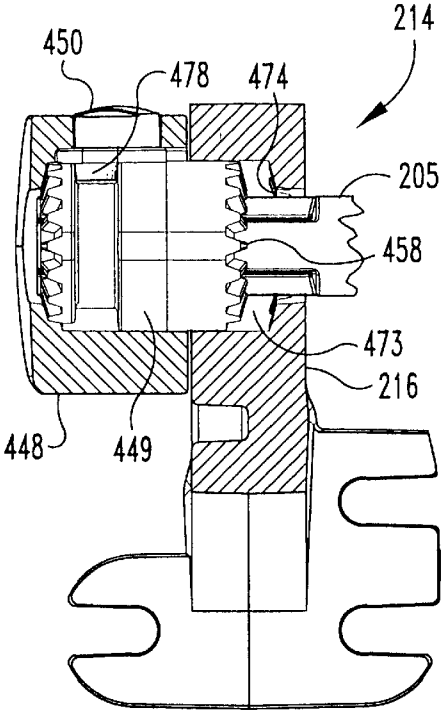
FIG. 44 is a top cross-sectional view of the lid select mechanism 214 of apparatus 200 of FIG. 42 taken along the lines 44—44 and viewed in the direction of the arrows, and shown with hub select 449 adjusted to engage shaft 205 with lid 202.
Figure 49:
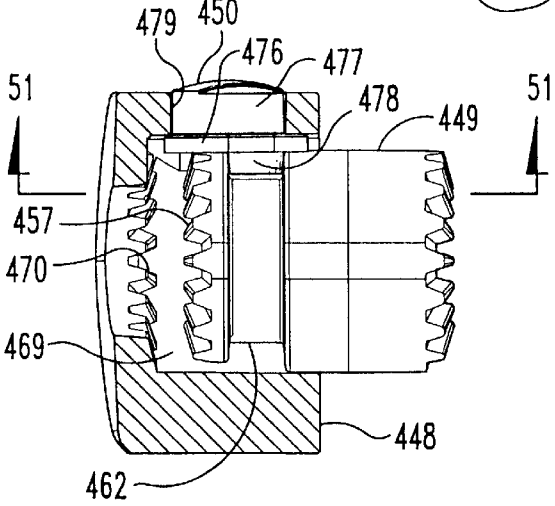
FIG. 49 is a top cross-sectional showing hub select 449 after being loaded into left hinge cover 448.

To assemble lid select mechanism 214, dial select 450 is positioned in hole 479. Hub select 449 is then slid into hole 469 (FIG. 50), the gap 463 in splines 457 providing clearance for splines 457 to pass beyond the inwardly protruding dial post 478 until dial post 478 is aligned in circumferential recess 462 (FIG. 49). Left hinge member 216 is then positioned up against left hinge cover 448 with the end of hub select 449 with splines 458 being inserted into hole 473 until left hinge cover 448 and left hinge member 216 rest side-by-side and with hub select 449 floating within now aligned holes 469 and 473 (as shown in FIGS. 44–46). In the idle position of hub select 449 shown in FIG. 45, neither splines 457 nor 458 of hub select 449 are engaged with the splines 470 or 474 of either left hinge cover 448 or left hinge member 216. Therefore, both the corresponding lid 202 and seat 203 may rotate freely about shaft 205. To engage shaft 205 with just seat 203, seat 203 must be in the lid down position, whereby the fat spline (not shown) of left hinge member 216 will only align with the corresponding gap 459 in hub select 449. Also it is only in this position that dial select pin 450 may be accessed. That is, referring to FIG. 39, only when lid 202 in the down position is lid hinge cover 448 rotated to expose dial select pin 450 where it may then be rotated within hole 479. Rotation of dial select pin 450 moves boss 478 in a slightly arcuate path, that path being in a plane parallel to axis 213. By virtue of the positionment of boss 478 within circumferential recess 462, rotation of dial select pin 450 moves hub select 449 axially along axis 213. To engage shaft 205 with just seat 203, dial select pin 450 is rotated which moves hub select 449 and its splines 458 into engagement with splines 474 of left hinge member 216. Likewise, rotation of dial select pin 450 in the opposite direction translates hub select 449 to the right until splines 457 have engaged with splines 470 of left hinge member 216 (again, only when lid 202 is in the lid down position so that fat spline 471 aligns with the corresponding gap (not shown) on hub select 449). Shaft 205 would thereby be engaged to rotate as a unit with lid 202.

Referring to FIG. 51, the configuration of hole 479 and rectangular recess 480 and of the stop surfaces 487 and 488 of dial select pin 450 restricts rotation of pin 450 within hole 479 to a 180° range of rotation. In FIG. 51, pin 450 is shown rotated to the clockwise limit whereby stop surface 487 contacts wall 496 of recess 480. In this position, hub select 449 is translated to the right and would be engaged with the splines 474 of left hinge member 216 to lock hub select 449 and shaft 205 with left hinge member 216 and seat 203. To change engagement of hub select 449 from seat 203 to lid 202, pin 450 is rotated through its 180° range counterclockwise until stop surface 488 engages wall 496, whereby hub select 449 translates along shaft 205 and splines 457 engage with the splines 470 of left hinge cover 448, thereby locking hub select 449 and shaft 205 with left hinge cover 448 and lid 202.

Referring to the cross-sectional view of FIGS. 20, 38, 39 and 42, an assembly is provided for releasably coupling lid 202 with seat 203, that assembly including left hinge member 216, left hinge cover 448, latch lever 481, pin 482, and coil spring 483. Latch lever 481 is pivotally mounted to the underside of left hinge member 216 by a pin 484, as shown. Pin 482 is Fixedly received within a hole 485 and extends therefrom generally parallel to axis 213. The rear most end 486 of latch lever 481 is angled about 30 degrees relative to a line perpendicular to a line connecting the centers of pins 482 and 484. Coil spring 43 is received within cavities 489 and 490 in seat 203 and latch lever 481, respectively, to maintain a constant bias torque on latch lever 481 toward the engaged position shown in solid lines in FIG. 42. A leftwardly opening slot 491 is defined in left hinge member 216, the slot 491 being defined in an arcuate path to correspond with the path of pin 482 when left hinge cover 448 rotates about axis 213 relative to left hinge cover 216, as described herein. This assembly operates to couple lid 202 with seat 203 unless desired otherwise, in which case lid 202 and seat 203 may be easily pulled apart. In practice, with lid 202 and seat 203 in the seat down and lid down positions resting atop toilet bowl 445, the forward end 492 of latch lever 481 engages with toilet bowl 445 and pivots lever 481, against the bias of spring 483, about pivot pin 484 thereby dropping the rear most end 486 away from pin 482. (as shown at 493) If lid 202 is lifted by itself, pin 482 will sweep right on past latch lever 481 and up through slot 491 for its normal operation. However, once seat 203 is lifted just a short distance away from bowl 445, latch lever 481 will pivot counterclockwise back to its engaged position, whereby if lid 202 and scat 203 are brought back together, pin 42 will engage with latch lever 481 until it passed beyond slanted surface 486, and lid 202 and seat 203 will again be constrained to pivot together. Furthermore, if both lid 202 and scat 203 are in the up position, and lid select mechanism 214 is adjusted so that only lid 202 is engaged with and controlled by shaft 205, when apparatus 200 operates to closed lid 202, it will naturally push seat 203 to the closed position, as well, until gravity takes over and attempts to pull seat 203 away from lid 202. However, because of the engagement of the rear most slanted surface end 486 with pin 482, lid 202 and seat 203 will stayed coupled together, and apparatus 200 will in effect lower both lid 202 and seat 203 gently to the lid down position. Further, if lid select mechanism 214 is adjusted to just operate with seat 203, and both lid 202 and seat 203 are in the up position, and apparatus 200 begins to rotate seat 203, lid 202 will be pulled to move with seat 203 by virtue of latch lever 481. If it is desired, before lid 202 and seat 203 have fully descended, to reopen just lid 202, a slight amount of pulling force will release lid 202 from seat 203, the amount of force required to manually separate lid 202 and seat 203 being variably dependent upon factors such as the spring constant K of spring 483, the radial arm distances of spring 483 and slanted surface 486 from pivot pin 484, the angle of slanted surface 486 and the diameter of pin 482.

In operation, with lid select mechanism 214 adjusted so that shaft 205 is coupled to operate solely with lid 202 so that lid 202 can be lifted without seat 203 which remains in the down position against bowl 445, lifting lid 202 will rotate shaft 205 which rotates clutch brake hub 218 through approximately 45 degrees. Further lifting of lid 202 rotates shaft 205 and hub 218, whereby facedog engagement 224 engages with and rotates facedog engagement 233 of torsion spring assembly 206 which consequently stores energy therein. In the lid down position, ball bearings 261 reside substantially along a horizontal line 281 (FIG. 28) within groove 280 of shift plate 259. In assembly, the various plates 251, disks 252, shift plate 259, ball carrier 260, brake pressure plate 253, right pressure plate 254, brake disk 265, and spacer 266 are coaxially sandwiched between one stop surface (face dog engagement 224) of hub 218 and an opposing stop surface (nut 314) that is variably positioned onto hub 318. Nut 314 is tightened to compress the various plates, disks, spacer and ball carrier between nut 314 and facedog engagement 224 so that just a certain small amount of friction is created between the alternating brake plates 251 and brake disks 252. Such minimal friction compression produces substantially no torque resistive to the rotation of shaft 205 or the elements splined to rotate therewith.

When lid 202 is lifted from the lid down position, ball bearings 261 rotate within groove 280 (clockwise as shown in FIG. 28). When ball bearings 261 reach the ramp (at 283) and travel from the 0.011 inch groove 284 to the 0.006 inch groove 287, the system enters a timer mode (closed loop feedback control), and shift plate 259 and brake pressure plate 253 are spread apart by 0.005 inches, and the various plates, disks and ball carrier, between nut 314 and faced on engagement 224, are forced closer together to one another, although not so much to create a significant amount of resistive torque among the various plates and disks. When lid 202 is lifted to its lid up position (generally indicated in FIG. 20 and shown in FIG. 38), ball bearings 261 have traveled into groove 287 and approximately 10° clockwise of the vertical line 499. Rotation of shaft 205 to the lid up position has rotated substantially or entirely free of rotor 320 by virtue of spring clutch 322.

As soon as lid 202 is released, torsion spring assembly 206 attempts to unwind and applies a counterclockwise (as viewed from the right) torque on shaft 205 via the coupling between facedog engagements 224 and 233. The counterclockwise rotation of shaft 205, and thus hub 218, engages spring clutch 322 which transmits the counterclockwise torque to rotor 320, which then also tries to rotate counterclockwise. The counterclockwise rotation of rotor 320 is in turn transmitted through the dilatant compound within main rotor housing 323 to rotor casing 318 which rotates counterclockwise within housing 201. The size of slot 345 in lower housing half 239 (FIG. 20) determines the limit of rotation of rotor casing 318. That is, rotor casing 318 may rotate within lower housing half 239 between a rest position, whereby rotor control arm 330 is at its forward most position (FIG. 39), and a fully engaged position, whereby rotor control arm 330 is positioned at its rear most position within slot 345 (FIG. 38).

Without the force of counterbalance spring 354 acting on rotor control arm 330, rotation of rotor casing 318 to a position between the rest and fully engaged position will rotate brake levers 255 and 256 about their axis of rotation 296, which will force brake pressure plate 253 axially away from right pressure plate 254, which action exerts a normal force between brake plates 251 and brake disks 252, and consequently a frictional torque between brake disks 252 that are splined to hub 218, and brake plates 251 that are constrained from rotation within housing 201. Consequently, shaft 205 and lid 202 are prevented from further closing rotation. Absent an outside force acting to pivot brake levers 255 and 256 back to their resting position (FIG. 21), apparatus 200 will stay in the braking condition and lid 202 will stay up.

However, counterbalance spring 354 is provided to exert a force against rotor control arm 330 to urge rotor casing 318 back toward its rest position and against the torque exerted through the dilatant compound therewithin. Consequently, rotor casing 318 will rotate slightly clockwise (as viewed in FIG. 21), thereby allowing a slight backing off of brake levers 255 and 256 which in turn reduces the normal force among brake plates 251 and brake disks 252, and shaft 205 and hub 218 are slightly freed to rotate. However, the torque applied through torsion spring assembly 206 again attempts to rotate shaft 205 and hub 218, and thus rotor casing 318, through spring clutch 322, which acts to reapply the braking action through levers 255 and 256. The system described is a closed loop control system which maintains a desired rate of rotation of shaft 205 in the timer mode (ball bearings 261 in the 0.006 inch groove 287). The rate of rotation of shaft 205 is controlled by controlling the torque exerted through the dilatant compound. The counterbalance spring along with the geometry of the control arm 330 and position of the spring arm in the lower case approximates a constant reference torque applied to the rotor casing 318. The rate of rotation desired is set by the counterbalance spring. The resultant constant torque is the torque exerted by the dilatant compound at the desired rate of rotation. If the rate of rotation of shaft 205 exceeds the desired rate of rotation, the torque transmitted from the shaft and through the dilatant compound exceeds the counterbalance torque, and rotor casing 318 rotates and brake levers 255 and 256 actuate the brake assembly, which slows the rate of shaft rotation. Brake levers 255 and 256 are the feedback components and the brake assembly is the controller of the loop.

By sliding timer adjust slide 355 within lateral opening 423, the force exerted by counterbalance spring 354 to rotor control arm 330 can be varied. In one embodiment, adjustment of timer adjust slide 355 can result in a stable timing delay sequence of between 5 and 20° of rotation of shaft 205 per minute from the fully opened position.

As shaft 205 slowly rotates from its fully opened position toward the lid down position, ball bearings 281 will rotate within groove 287 until they pass into the deeper groove 284 where the system exits the timer mode and the rotor damper assembly then functions as a simple rotary damper. The timer mode is exited because, when ball bearings 281 pass into the deeper groove 284, the axial distance between brake plates 251 and brake disks 252 is sufficiently relaxed that the pivoting of brake levers 255 and 256 no longer creates a significant braking action. Torsion spring assembly 206 still has approximately 25° of rotation before facedog engagements 224 and 233 disengage, and lid 202 is continued to be urged to the down position. Because of spring clutch 322, rotating shaft 205 is still coupled to rotate counterclockwise (as viewed from the right) and is now constrained for a slow, controlled descent to the lid down position by virtue of the dilatant compound between rotor 320 and rotor casing 318.

It is also noted that, like lid 18 of apparatus 10, lid 202 and/or seat 203 may be closed manually before its timed descent as controlled by apparatus 200 by simply pulling lid 202 or seat 203 toward the down position. When a moderate force is applied to manually close the lid or seat, the dilatant compound will permit rotor 320 to rotate within rotor casing 318 with only slight resistance.

While the invention has been illustrated and describe in detail in the drawings and foregoing description, the same is to be considered as illustrative and not restrictive in character, it being understood that only the preferred embodiment has been shown and described and that all changes and modifications that come within the spirit of the invention are desired to be protected.

We claim:

1. An apparatus for automatically pivoting a first member relative to a second member, comprising:

a housing connectable to the second member;

a shaft connectable to the first member and juxtaposed to rotate about its axis within said housing between a rest position and an open position, said shaft having first and second rates of rotation in a closing direction from the open to the rest position;

a torsion spring assembly connected between said housing and said shaft;

dampening means connected between said housing and said shaft for exerting a dampening torque upon said shaft during at least one direction of rotation of said shaft relative to said housing;

time delay means connected between said housing and said shaft for exerting a braking torque on said shaft;

a shift assembly connected between said housing and said shaft and operable to enable and disable said time delay means; and, clutch means for engaging said shaft with said dampening means and said time delay means when torque is applied to rotate said shaft in the closing direction.

2. The apparatus for automatically pivoting a first member relative to a second member of claim 1 wherein said time delay means includes a braking assembly connected between said housing and said shaft and operable upon activation to exert the braking torque upon said shaft.

3. The apparatus for automatically pivoting a first member relative to a second member of claim 2 wherein said shift assembly is operable to enable and disable the braking assembly of said time delay means as a function of the angle of pivot of said shaft relative to said housing.

4. The apparatus for automatically pivoting a first member relative to a second member of claim 3 wherein the first rate of rotation includes said braking assembly being enabled by said shift assembly and the second rate of rotation includes said braking assembly being disabled by said shift assembly, and wherein said time delay means is adjustable to vary the first rate of rotation.

5. The apparatus for automatically pivoting a first member relative to a second member of claim 4 wherein said dampening means includes a rotor casing mounted for limited rotation in said housing, a rotor mounted for rotation within said rotor casing and engagable by said clutch means to rotate as a unit in the closing direction with said shaft, and fluid means disposed between said rotor casing and said rotor for retarding rotation between said rotor casing and said rotor.

6. The apparatus for automatically pivoting a first member relative to a second member of claim 5 wherein said fluid means is a dilatant compound.

7. The apparatus for automatically pivoting a first member relative to a second member of claim 5 wherein said clutch means is a coil spring.

8. The apparatus for automatically pivoting a first member relative to a second member of claim 5 wherein said shaft includes a clutch/brake hub having a generally cylindrical portion with a hub diameter, and wherein said rotor has a generally cylindrical member with a rotor diameter substantially equal to the hub diameter, and wherein said clutch means is a coil spring coaxially received over both the generally cylindrical portion of the hub and the generally cylindrical member of the rotor.

9. The apparatus for automatically pivoting a first member relative to a second member of claim 5 wherein the first member is a toilet bowl and the second member is one of a toilet lid and a toilet seat and further including a timer interrupt assembly operable to temporarily stop rotation of said shaft relative to said housing when a force is applied to bias the toilet seat against the toilet bowl.

10. The apparatus for automatically pivoting a first member relative to a second member of claim 9 wherein the timer interrupt assembly includes a hinge member having an opening through which extends one end of said shaft, the hinge member being fixed to rotate with the toilet seat.

11. The apparatus for automatically pivoting a first member relative to a second member of claim 10 wherein the hinge member includes a brake activation arm extending below the seat for engagement with the toilet bowl, when the seat is biased down toward the toilet bowl, to bias the brake activation arm toward the seat and thereby reduce the size of the opening whereby the hinge member tightly grips said shaft.

12. The apparatus for automatically pivoting a first member relative to a second member of claim 1 wherein said torsion spring assembly includes a resilient tube coaxially received over said shaft and fixed at a first end to said housing, the second, opposite end of the tube being mechanically engagable with said shaft to be rotated by said shaft.

13. The apparatus for automatically pivoting a first member relative to a second member of claim 12 wherein said torsion spring assembly further includes a plurality of rings coaxially received over said shaft, within the resilient tube and between the first and second ends of the resilient tube.

14. The apparatus for automatically pivoting a first member relative to a second member of claim 13 wherein said torsion spring assembly further includes a first face dog engagement fixed to the second end of the resilient tube, the first face dog engagement having at least one axially extending first face dog, and wherein said shaft includes a second face dog engagement, the second face dog engagement having at least one axially extending second face dog positioned to rotatably engage with the at least one first face dog through a spring-cocking angle.

15. The apparatus for automatically pivoting a first member relative to a second member of claim 14 wherein said shaft is juxtaposed within said housing, and the first and second face dogs are sized and configured, so that said shaft rotates about its axis from the rest position approximately 45 degrees to a torsion spring engagement position, and wherein the at least one second face dog does not engage with the at least one first face dog between the rest position and the torsion spring engagement position.

16. The apparatus for automatically pivoting a first member relative to a second member of claim 15 wherein upon rotation of said shaft from the torsion spring engagement position toward the open position, the at least one second face dog engages the at least one first face dog and rotates the first face dog engagement, against the bias of the resilient tube.

17. The apparatus for automatically pivoting a first member relative to a second member of claim 14 wherein there are two first face dogs and two second face dogs.

18. The apparatus for automatically pivoting a first member relative to a second member of claim 2 wherein the braking assembly includes at least one brake plate having an axis, coaxially and slidably received over said shaft and held against rotation about its axis by said housing, said braking assembly further including at least one brake disk coaxially and slidably received over said shaft and constrained by said shaft to rotate with said shaft.

19. The apparatus for automatically pivoting a first member relative to a second member of claim 18 wherein one of the at least one brake plate and the at least one brake disk is made of a paper-based Phenolic.

20. The apparatus for automatically pivoting a first member relative to a second member of claim 18 wherein there are at least three brake plates and at least three brake disks.

21. The apparatus for automatically pivoting a first member relative to a second member of claim 18 wherein there are five brake plates and five brake disks received in an alternating, coaxial arrangement over said shaft.

22. The apparatus for automatically pivoting a first member relative to a second member of claim 18 wherein said shaft includes at least one spline and the at least one brake disk is shaped to engage with the at least one spline to rotate as a unit with said shaft.

23. The apparatus for automatically pivoting a first member relative to a second member of claim 18 wherein said braking assembly further includes:

first and second pressure plates coaxially received over said shaft, and at least one brake lever comprising a leg having opposed first and second ends, the first end including a head which extends between the first and second pressure plates and wherein said at least one brake lever pivots about a lever axis at the first end of said at least one brake.

24. The apparatus for automatically pivoting a first member relative to a second member of claim 23 wherein said time delay means further includes a rotor casing coaxially received over and intermittently rotatable by said shaft, and wherein the rotor casing is engagable with the second end of said at least one brake lever to pivot said at least one brake lever about the lever axis, the lever axis generally orthoganally intersecting the shaft axis.

25. The apparatus for automatically pivoting a first member relative to a second member of claim 24 wherein the head of said at least one brake lever has an arcuate recess-engaging surface and an opposing pressure plate engaging surface, and wherein the first pressure plate defines an arcuate recess shaped to receive the arcuate recess-engaging surface.

26. The apparatus for automatically pivoting a first member relative to a second member of claim 1 wherein said shift assembly includes a shift plate, a ball carrier and at least one ball bearing.

27. The apparatus for automatically pivoting a first member relative to a second member of claim 26 wherein said shift plate and ball carrier are mutually adjacent and are coaxially received over said shaft, and wherein said ball carrier defines at least one hole sized to receive the at least one ball bearing.

28. The apparatus for automatically pivoting a first member relative to a second member of claim 27 wherein one of said ball carrier and said shift plate is constrained by said shaft to rotate at a unit with said shaft and the other of said ball carrier and said shift plate is held against rotation relative to said housing by said housing.

29. The apparatus for automatically pivoting a first member relative to a second member of claim 27 wherein said ball carrier is constrained by said shaft to rotate at a unit with said shaft and said shift plate is held against rotation relative to said housing by said housing.

30. The apparatus for automatically pivoting a first member relative to a second member of claim 29 wherein said shift plate defines an arcuate groove that is aligned with the at least one hole of said ball carrier, wherein the groove has a first depth through a first angle and has a second depth through a second angle, and wherein said at least one ball bearing resides substantially entirely within the at least one hole and rides within the arcuate groove as said ball carrier rotates relative to said shift plate.

31. The apparatus for automatically pivoting a first member relative to a second member of claim 30 wherein said ball carrier has an axis and an axial length and there are two of said at least one holes in said ball carrier, said two holes each extending the entire axial length of said ball carrier and having axes parallel to and equidistant from the axis of said ball carrier.

32. The apparatus for automatically pivoting a first member relative to a second member of claim 30 wherein said time delay means includes a braking assembly connected between said housing and said shaft and operable upon activation to exert a braking torque upon said shaft, wherein said braking assembly includes a first pressure plate coaxially received over said shaft and adjacent said ball carrier, wherein said ball carrier has an axis and an axial length and the at least one hole of said ball carrier extends the entire axial length of said ball carrier and has an axis parallel to the axis of said ball carrier, and wherein there are two of said at least one ball bearings axially received in the at least one hole, the sum of the diameters of said two ball bearings being slightly greater than the axial length of said ball carrier whereby one of the two ball bearings rides within the arcuate groove of said shift plate and the other of the two ball bearings rides in an arcuate path against said first pressure plate, and wherein the distance between said shift plate and said first pressure plate is defined by the angular position of said at least one hole with the two ball bearings contained therein relative to the arcuate groove.

33. The apparatus for automatically pivoting a first member relative to a second member of claim 32 wherein there are two of said at least one holes in said ball carrier, said two holes each extending the entire axial length of said ball carrier and having axes parallel to and equidistant from the axis of said ball carrier, and wherein each hole receives two of said at least one ball bearings, one ball bearing from each hole riding within the arcuate groove, and the other ball bearing from each hole riding against the first pressure plate.

34. The apparatus for automatically pivoting a first member relative to a second member of claim 32 wherein said first pressure plate defines an arcuate groove that is aligned with the at least one hole of said ball carrier and wherein the other of the two ball bearings rides within the arcuate groove of said pressure plate.

35. The apparatus for automatically pivoting a first member relative to a second member of claim 30 wherein the first depth is approximately 0.011 inches.

36. The apparatus for automatically pivoting a first member relative to a second member of claim 30 wherein the difference between the first depth and the second depth is approximately 0.005 inches.

37. The apparatus for automatically pivoting a first member relative to a second member of claim 30 wherein the first angle is approximately 70 degrees.

38. The apparatus for automatically pivoting a first member relative to a second member of claim 30 wherein the second angle is approximately 12 degrees.

39. The apparatus for automatically pivoting a first member relative to a second member of claim 30 wherein the groove has a transitioning, varying depth through a third angle juxtaposed between the first and second angles.

40. The apparatus for automatically pivoting a first member relative to a second member of claim 39 wherein the third angle is approximately 8 degrees.

41. The apparatus for automatically pivoting a first member relative to a second member of claim 1 wherein said time delay means includes:

a braking assembly connected between said housing and said shaft and operable upon activation to exert the braking torque upon said shaft, said braking assembly including at least one brake lever for activating said braking assembly;

a rotor casing coaxially received over said shaft and held for rotation within said housing between a casing rest position and a casing fully engaged position, and wherein the rotor casing is engagable, upon rotation from the casing rest position toward the casing fully engaged position, with the at least one brake lever to activate said braking assembly;

a rotor mounted for rotation within said rotor casing and engagable by said clutch means to rotate as a unit in the closing direction with said shaft; and, fluid means disposed between said rotor casing and said rotor for retarding rotation between said rotor casing and said rotor.

42. The apparatus for automatically pivoting a first member relative to a second member of claim 41 wherein rotation of said rotor in the closing direction urges said rotor casing, via said fluid means, to rotate in the closing direction which is from the casing rest position toward the casing fully engaged position.

43. The apparatus for automatically pivoting a first member relative to a second member of claim 42 wherein said time delay means further includes a counterbalance spring operable between said housing and said rotor casing to bias said rotor casing toward the casing rest position.

44. The apparatus for automatically pivoting a first member relative to a second member of claim 43 wherein the magnitude of bias exerted by said counterbalance spring on said rotor casing is adjustable.

45. The apparatus for automatically pivoting a first member relative to a second member of claim 43 wherein said housing defines an aperture and said rotor casing includes a rotor control arm that extends through the aperture, and wherein the counterbalance spring has first and second ends, the first end being mounted to said housing and the second end being engaged with the rotor control arm to bias said rotor casing toward the casing rest position.

46. The apparatus for automatically pivoting a first member relative to a second member of claim 45 wherein said time delay means further includes a spacer member mounted for sliding movement in said housing for engagement with the counterbalance spring between the first and second ends to vary the magnitude of bias exerted by said counterbalance spring on said rotor casing.

47. The apparatus for automatically pivoting a first member relative to a second member of claim 41 wherein said dampening means includes the rotor casing, the rotor and the fluid means when said time delay means is disabled by said shift means.

48. The apparatus for automatically pivoting a first member relative to a second member of claim 1 wherein the first member is a toilet bowl and the second member is one of a toilet lid and a toilet seat and further including lid select means connected with said shaft and said second member for selectively engaging said shaft with said second member.

49. The apparatus for automatically pivoting a first member relative to a second member of claim 1 wherein the first member is a toilet bowl and the second member is one of a toilet lid and a toilet seat and further including a lid select assembly connected with said shaft and said second member, said lid select assembly having a disengaged position and a first engaged position, the disengaged position including said shaft being able to rotate independently of the second member and the first engaged position including said shaft being mechanically coupled to rotate as a unit with the second member.

50. The apparatus for automatically pivoting a first member relative to a second member of claim 49 wherein said second member includes first splines and wherein said shaft includes second splines coupled to rotate with said shaft and selectively engagable with the first splines of the second member.

51. The apparatus for automatically pivoting a first member relative to a second member of claim 49 wherein said lid select assembly includes:

a body connectable to the second member and having first splines, and a hub select member coaxially engaged to rotate as a unit with said shaft and having second splines configured for selective locking engagement with the first splines of the body to lock the body for rotation as a unit with said shaft, and wherein the disengaged position includes the first splines not being engaged with the second splines and the first engaged position includes the first splines being engaged with the second splines.

52. In an apparatus for automatically closing a toilet member, the toilet member comprising one of a toilet lid and toilet seat and being pivotally connected by a shaft to a toilet bowl, a lid select assembly, comprising:

a body rigidly connected to the toilet member and having first splines, and a hub select member coaxially engaged to rotate as a unit with the shaft and having second splines configured for selective locking engagement with the first splines of the body to lock the body for rotation as a unit with said shaft, and wherein the lid select assembly has a disengaged position and a first engaged position, the disengaged position including the first splines not being engaged with the second splines and the shaft being able to rotate independently of the toilet member and the first engaged position including the first splines being engaged with the second splines and the shaft being mechanically coupled to rotate as a unit with the toilet member.

53. An apparatus for automatically closing a toilet seat relative to a toilet bowl, comprising:

a housing connectable to the toilet bowl;

a shaft connectable to the toilet seat and juxtaposed to rotate about its axis within said housing between a rest position and an open position, said shaft having first and second rates of rotation in a closing direction from the open to the rest position;

a torsion spring assembly connected between said housing and said shaft;

dampening means connected between said housing and said shaft for exerting a dampening torque upon said shaft during at least one direction of rotation of said shaft relative to said housing;

time delay means connected between said housing and said shaft for variably exerting a braking torque on said shaft;

a shift assembly connected between said housing and said shaft and operable to enable and disable said time delay means; and, clutch means for engaging said shaft with said dampening means and said time delay means when torque is applied to rotate said shaft in the closing direction.

* * * * *